US006217149B1

(12) United States Patent
Takagi et al.

(10) Patent No.: US 6,217,149 B1
(45) Date of Patent: Apr. 17, 2001

(54) INK JET PRINTER

(75) Inventors: Akira Takagi; Hiroaki Tojo, both of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/147,415

(22) PCT Filed: Jun. 19, 1997

(86) PCT No.: PCT/JP97/02122

§ 371 Date: Dec. 21, 1998

§ 102(e) Date: Dec. 21, 1998

(87) PCT Pub. No.: WO97/48558

PCT Pub. Date: Dec. 24, 1997

(30) Foreign Application Priority Data

Jun. 19, 1996 (JP) ..... 8-158672
Oct. 24, 1996 (JP) ..... 8-282728

(51) Int. Cl.[7] ..... B41J 2/145; B41J 2/15; B41J 29/38; B41J 2/21

(52) U.S. Cl. ..... 347/41; 347/9; 347/12; 347/16; 347/43

(58) Field of Search ..... 347/41, 12, 16, 347/9, 43

(56) References Cited

U.S. PATENT DOCUMENTS 4,401,991 8/1983 Martin .
4,686,538 8/1987 Kouzato .

FOREIGN PATENT DOCUMENTS 0 388 978 A2 9/1990 (EP) .
0 517 519 A2 12/1992 (EP) .
0 679 518 A1 11/1995 (EP) .

*Primary Examiner*—Thinh Nguyen
(74) *Attorney, Agent, or Firm*—Oblon, Spivak, McClelland, Maier & Neustadt, P.C.

(57) ABSTRACT

An ink jet printer that produces a multi-value output of a multi-tone image. The printer includes a main scan driving unit that drives print head with two nozzle arrays in a main scanning direction relative to a printing medium. Each nozzle array has a preset number of nozzles arranged in a fixed nozzle interval. A sub-scan driving unit drives the printing medium in a sub-scanning direction. A driving unit controller controls the main scan driving unit and the sub-scan driving unit to locate the print head at the determined positions. The print head driving unit supplies electric power for the print head based on print image data which includes multi-value tone information which is stored in the data storage unit. The binary output is based on the jetting or nonjetting of ink and the positional control by the driving unit controller causes the print head driving unit to superpose dots on the dots that have already been formed so as to carry out multi-value outputs.

20 Claims, 29 Drawing Sheets

FIRST DOT RECORDING SCHEME

PRIOR ART Fig. 1 (a)

| | | | | | | | |
|---|---|---|---|---|---|---|---|
| b7 | b6 | b5 | b4 | b3 | b2 | b1 | b0 |

PRIOR ART Fig. 1 (b)

Fig. 8(A) ARRANGEMENT OF NOZZLE ARRAYS
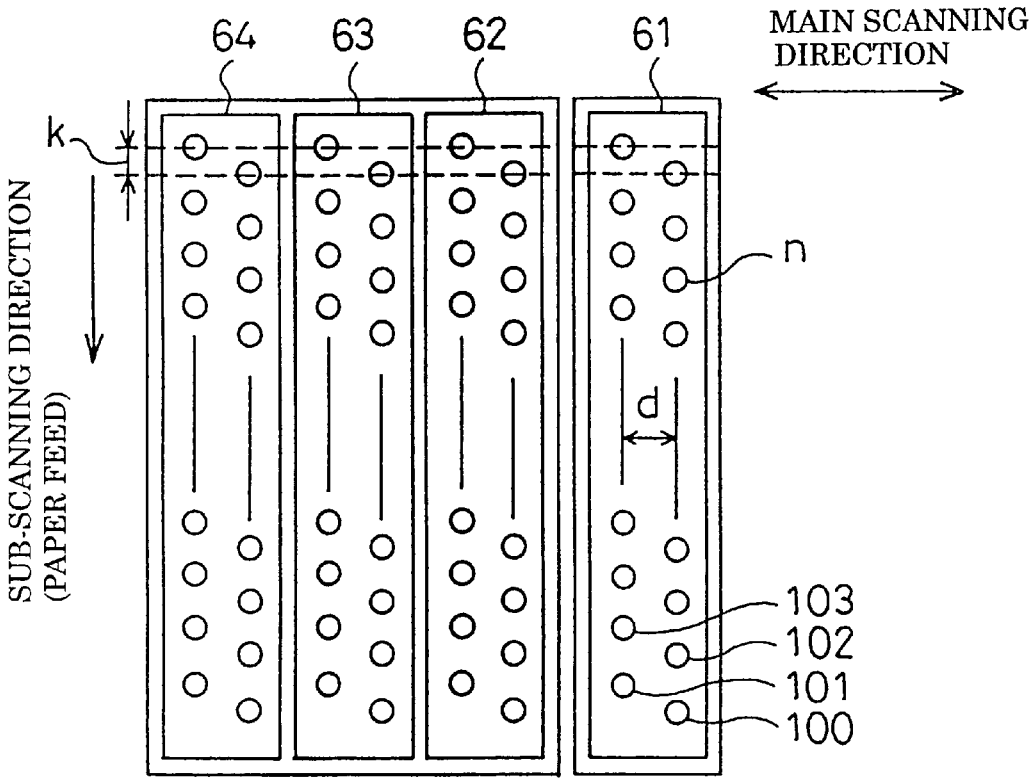
Fig. 8(B) DOTS FORMED BY ONE NOZZLE ARRAY
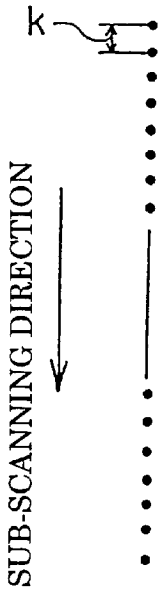

Fig. 18

| TONE VALUES | 0 | 1 | 2 | 3 | 4 | 5 |
|---|---|---|---|---|---|---|
| INK | NONE | LIGHT | LIGHT + LIGHT | DARK | DARK + LIGHT | DARK + DARK |
| NOZZLES | | ▷ | ▷ ◇ | □ | □ ◇ | □ ○ |
| DARK NOZZLE DATA PRECEDING, FOLLOWING | 0 , 0 | 0 , 0 | 0 , 0 | 1 , 0 | 1 , 0 | 1 , 1 |
| LIGHT NOZZLE DATA PRECEDING, FOLLOWING | 0 , 0 | 1 , 0 | 1 , 1 | 0 , 0 | 0 , 1 | 0 , 0 |
| CONCEPTUAL PLAN VIEWS OF DOTS | ○ | ◐ | ◐ | ◐ | ◐ | ● |

Fig. 19 (A) CONCEPT OF SUB-SCAN FEED (s=1)
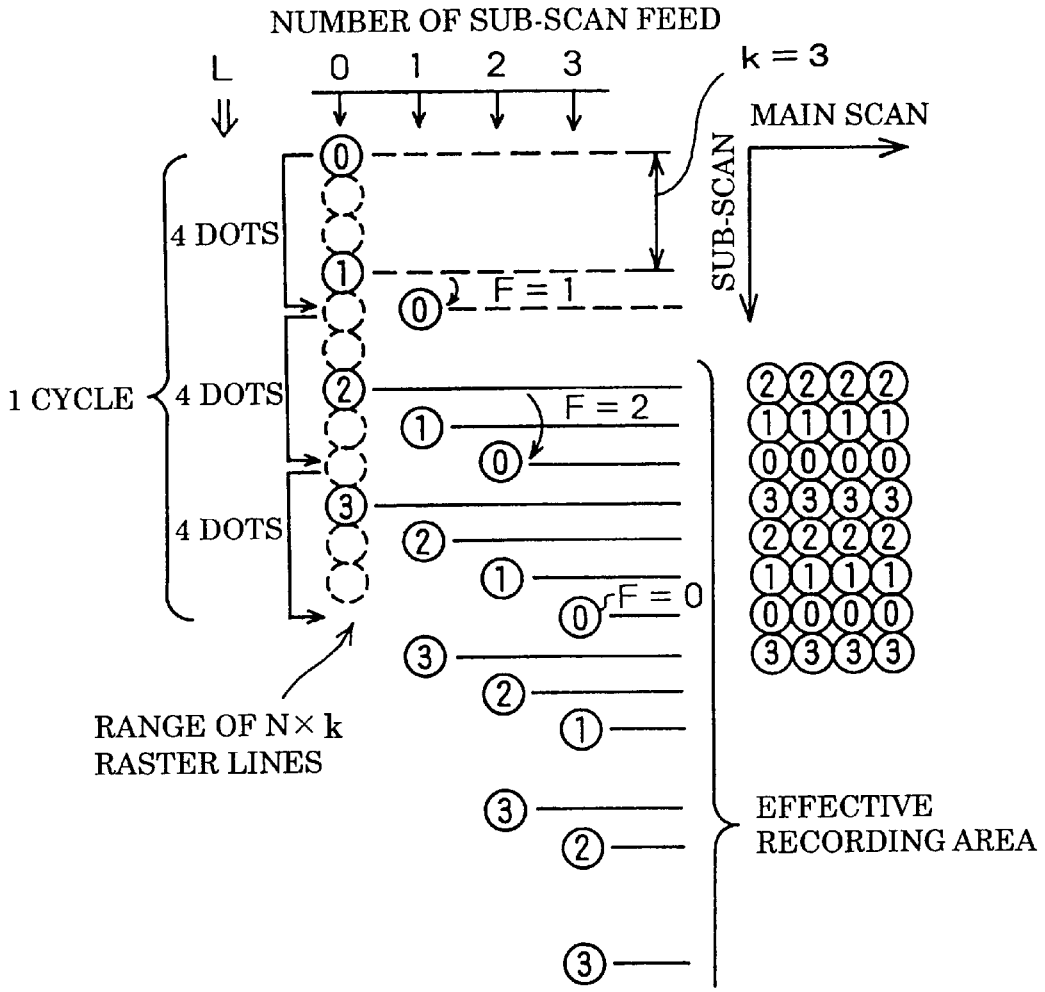
Fig. 19 (B) PARAMETERS
NOZZLE PITCH k : 3 [dot]
NUMBER OF USED NOZZLES N : 4
NUMBER OF SCAN REPEATS s : 1
NUMBER OF EFFECTIVE NOZZLES Neff : 4
| NUMBER OF SUB-SCAN FEED | 0 | 1 | 2 | 3 |
|---|---|---|---|---|
| FEED AMOUNT L [dot] | 0 | 4 | 4 | 4 |
| Σ L | 0 | 4 | 8 | 12 |
| F = (Σ L) %k | 0 | 1 | 2 | 0 |

Fig. 20(A) CONCEPT OF SUB-SCAN FEED (s=2)
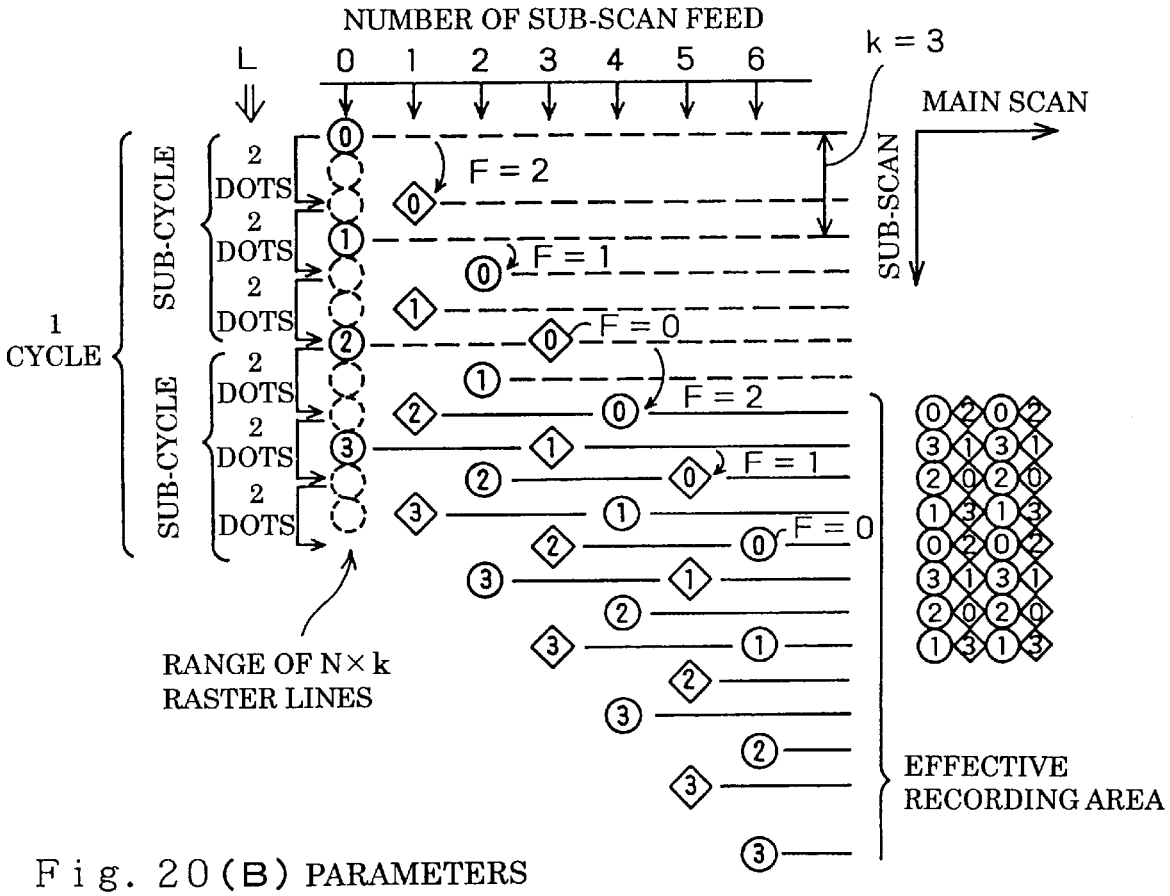
Fig. 20(B) PARAMETERS
NOZZLE PITCH k : 3 [dot]
NUMBER OF USED NOZZLES N : 4
NUMBER OF SCAN REPEATS s : 2
NUMBER OF EFFECTIVE NOZZLES Neff : 2
| NUMBER OF SUB-SCAN FEED | 0 | 1 | 2 | 3 | 4 | 5 | 6 |
|---|---|---|---|---|---|---|---|
| FEED AMOUNT L [dot] | 0 | 2 | 2 | 2 | 2 | 2 | 2 |
| Σ L | 0 | 2 | 4 | 6 | 8 | 10 | 12 |
| F = (Σ L) % k | 0 | 2 | 1 | 0 | 2 | 1 | 0 |

Fig. 21 FIRST DOT RECORDING SCHEME
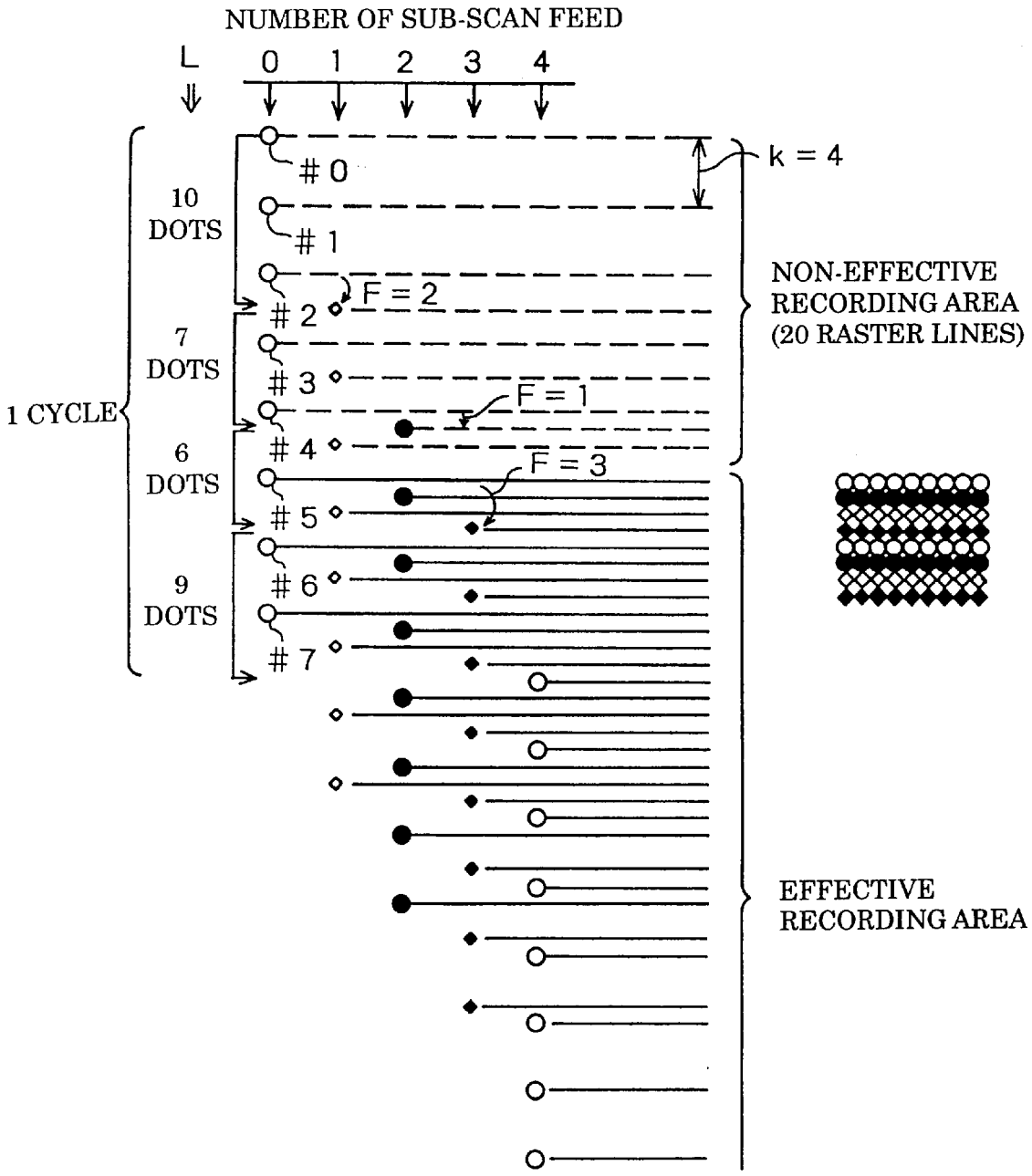
SCAN PARAMETERS
NOZZLE PITCH k : 4 [dot]
NUMBER OF NOZZLES N : 8
NUMBER OF SCAN REPEATS s : 1
NUMBER OF EFFECTIVE NOZZLES Neff: 8

FIRST SCANNING SCHEME

Fig. 22(A) SCAN PARAMETERS

NOZZLE PITCH k : 4 [dot]
NUMBER OF USED NOZZLES N : 8
NUMBER OF SCAN REPEATS s : 1
NUMBER OF EFFECTIVE NOZZLES Neff : 8

| NUMBER OF SUB-SCAN FEED | 0 | 1 | 2 | 3 | 4 |
|---|---|---|---|---|---|
| FEED AMOUNT L [dot] | 0 | 10 | 7 | 6 | 9 |
| Σ L | 0 | 10 | 17 | 23 | 32 |
| F = (Σ L) % k | 0 | 2 | 1 | 3 | 0 |
| G = L % k | 0 | 2 | 1 | 2 | 1 |

Fig. 22(B) RASTER NUMBERS OF EFFECTIVE RASTER LINES RECORDED BY RESPECTIVE NOZZLES

| | NUMBER OF SUB-SCAN FEED | | | | | | | |
|---|---|---|---|---|---|---|---|---|
| NOZZLE | 0 | 1 | 2 | 3 | 4 | 5 | 6 | 7 |
| #0: | . | . | . | 4 | 13 | 23 | 30 | (36) |
| #1: | . | . | 2 | 8 | 17 | 27 | (34) | (40) |
| #2: | . | . | 6 | 12 | 21 | 31 | (38) | (44) |
| #3: | . | 3 | 10 | 16 | 25 | (35) | (42) | (48) |
| #4: | . | 7 | 14 | 20 | 29 | (39) | (46) | (52) |
| #5: | 1 | 11 | 18 | 24 | (33) | (43) | (50) | (56) |
| #6: | 5 | 15 | 22 | 28 | (37) | (47) | (54) | (60) |
| #7: | 9 | 19 | 26 | 32 | (41) | (51) | (58) | (64) |

Fig. 23

NOZZLE NUMBERS FOR RECORDING RESPECTIVE RASTER LINES (FIRST SCANNING SCHEME)

| | | | NUMBER OF SUB-SCAN FEED | | | | | | |
|---|---|---|---|---|---|---|---|---|---|
| RASTER | @ | Δ | 0 | 1 | 2 | 3 | 4 | 5 | 6 |
| 1 | • | – | #5 | | | | | | |
| 2 | X | 2 | . | . | #1 | | | | |
| 3 | • | – | . | #3 | | | | | |
| 4 | X | 3 | . | . | . | #0 | | | |
| 5 | • | – | #6 | | | | | | |
| 6 | X | 2 | . | . | #2 | | | | |
| 7 | • | – | . | #4 | | | | | |
| 8 | X | 3 | . | . | . | #1 | | | |
| 9 | • | – | #7 | | | | | | |
| 10 | X | 2 | . | . | #3 | | | | |
| 11 | • | – | . | #5 | | | | | |
| 12 | ↑ | 2 | . | . | . | #2 | | | |
| 13 | X | 2 | . | . | . | . | #0 | | |
| 14 | ↓ | 1 | . | . | #4 | | | | |
| 15 | • | – | . | #6 | | | | | |
| 16 | ↑ | 2 | . | . | . | #3 | | | |
| 17 | X | 2 | . | . | . | . | #1 | | |
| 18 | ↓ | 1 | . | . | #5 | | | | |
| 19 | • | – | . | #7 | | | | | |
| 20 | ↑ | 2 | . | . | . | #4 | | | |
| 21 | X | 2 | . | . | . | . | #2 | | |
| 22 | • | – | . | . | #6 | | | | |
| 23 | X | 3 | . | . | . | . | . | #0 | |
| 24 | • | – | . | . | . | #5 | | | |
| 25 | X | 2 | . | . | . | . | #3 | | |
| 26 | • | – | . | . | #7 | | | | |
| 27 | X | 3 | . | . | . | . | . | #1 | |
| 28 | • | – | . | . | . | #6 | | | |
| 29 | ↑ | 1 | . | . | . | . | #4 | | |
| 30 | X | 2 | . | . | . | . | . | . | #0 |
| 31 | ↓ | | . | . | . | . | . | #2 | |

SECOND SCANNING SCHEME

Fig. 24(A) SCAN PARAMETERS

NOZZLE PITCH k : 8 [dot]
NUMBER OF NOZZLES N : 16
NUMBER OF SCAN REPEATS s : 1
NUMBER OF EFFECTIVE NOZZLES Neff : 16

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 13 | 21 | 13 | 13 | 21 | 13 | 21 | 13 |
| Σ L | 0 | 13 | 34 | 47 | 60 | 81 | 94 | 115 | 128 |
| F = (Σ L) % k | 0 | 5 | 2 | 7 | 4 | 1 | 6 | 3 | 0 |
| G = L % k | 0 | 5 | 5 | 5 | 5 | 5 | 5 | 5 | 5 |

Fig. 24(B) RASTER NUMBERS OF EFFECTIVE RASTER LINES RECORDED BY RESPECTIVE NOZZLES

| | NUMBER OF SUB-SCAN FEED | | | | | | | | | | | | | | | |
|---|---|---|---|---|---|---|---|---|---|---|---|---|---|---|---|---|
| NOZZLE | 0 | 1 | 2 | 3 | 4 | 5 | 6 | 7 | 8 | 9 | 10 | 11 | 12 | 13 | 14 | 15 |
| # 0: | . | . | . | . | . | . | . | 8 | 21 | 34 | 55 | 68 | 81 | 102 | 115 | (136) |
| # 1: | . | . | . | . | . | . | . | 16 | 29 | 42 | 63 | 76 | 89 | 110 | 123 | (144) |
| # 2: | . | . | . | . | . | . | 3 | 24 | 37 | 50 | 71 | 84 | 97 | 118 | (131) | |
| # 3: | . | . | . | . | . | . | 11 | 32 | 45 | 58 | 79 | 92 | 105 | 126 | (139) | |
| # 4: | . | . | . | . | . | 6 | 19 | 40 | 53 | 66 | 87 | 100 | 113 | (134) | | |
| # 5: | . | . | . | . | . | 14 | 27 | 48 | 61 | 74 | 95 | 108 | 121 | (142) | | |
| # 6: | . | . | . | . | 1 | 22 | 35 | 56 | 69 | 82 | 103 | 116 | (129) | | | |
| # 7: | . | . | . | . | 9 | 30 | 43 | 64 | 77 | 90 | 111 | 124 | (137) | | | |
| # 8: | . | . | . | 4 | 17 | 38 | 51 | 72 | 85 | 98 | 119 | (132) | | | | |
| # 9: | . | . | . | 12 | 25 | 46 | 59 | 80 | 93 | 106 | 127 | (140) | | | | |
| #10: | . | . | 7 | 20 | 33 | 54 | 67 | 88 | 101 | 114 | (135) | | | | | |
| #11: | . | . | 15 | 28 | 41 | 62 | 75 | 96 | 109 | 122 | (143) | | | | | |
| #12: | . | 2 | 23 | 36 | 49 | 70 | 83 | 104 | 117 | (130) | | | | | | |
| #13: | . | 10 | 31 | 44 | 57 | 78 | 91 | 112 | 125 | (138) | | | | | | |
| #14: | 5 | 18 | 39 | 52 | 65 | 86 | 99 | 120 | (133) | | | | | | | |
| #15: | 13 | 26 | 47 | 60 | 73 | 94 | 107 | 128 | (141) | | | | | | | |

Fig. 25

NOZZLE NUMBERS FOR RECORDING RESPECTIVE RASTER LINES (SECOND SCANNING SCHEME)

| | | | NUMBER OF SUB-SCAN FEED | | | | | | | | |
|---|---|---|---|---|---|---|---|---|---|---|---|
| RASTER | @ | Δ | 0 | 1 | 2 | 3 | 4 | 5 | 6 | 7 | 8 |
| 1 | ↓ | 3 | . | . | . | . | #6 | | | | |
| 2 | • | – | . | #12 | | | | | | | |
| 3 | X | 5 | . | . | . | . | . | . | #2 | | |
| 4 | ↓ | 3 | . | . | . | #8 | | | | | |
| 5 | • | – | #14 | | | | | | | | |
| 6 | X | 5 | . | . | . | . | . | #4 | | | |
| 7 | • | – | . | . | #10 | | | | | | |
| 8 | X | 5 | . | . | . | . | . | . | . | #0 | |
| 9 | ↓ | 3 | . | . | . | . | #7 | | | | |
| 10 | • | – | . | #13 | | | | | | | |
| 11 | X | 5 | . | . | . | . | . | . | #3 | | |
| 12 | ↓ | 3 | . | . | . | #9 | | | | | |
| 13 | • | – | #15 | | | | | | | | |
| 14 | X | 5 | . | . | . | . | . | #5 | | | |
| 15 | • | – | . | . | #11 | | | | | | |
| 16 | X | 5 | . | . | . | . | . | . | . | #1 | |
| 17 | ↓ | 3 | . | . | . | . | #8 | | | | |
| 18 | • | – | . | #14 | | | | | | | |
| 19 | X | 5 | . | . | . | . | . | . | #4 | | |
| 20 | • | – | . | . | . | #10 | | | | | |
| 21 | X | 5 | . | . | . | . | . | . | . | . | #0 |
| 22 | ↓ | 3 | . | . | . | . | . | #6 | | | |
| 23 | • | – | . | . | #12 | | | | | | |
| 24 | X | 5 | . | . | . | . | . | . | . | #2 | |
| 25 | ↓ | 3 | . | . | . | . | #9 | | | | |
| 26 | • | – | . | #15 | | | | | | | |
| 27 | X | 5 | . | . | . | . | . | . | #5 | | |
| 28 | • | – | . | . | . | #11 | | | | | |
| 29 | X | 5 | . | . | . | . | . | . | . | . | #1 |
| 30 | ↓ | 3 | . | . | . | . | . | #7 | | | |
| 31 | • | – | . | . | #13 | | | | | | |
| 32 | X | 5 | . | . | . | . | . | . | . | #3 | |

Fig. 26

NOZZLE NUMBERS FOR RECORDING RESPECTIVE RASTER LINES (WHEN OFFSET G OF SUB-SCAN FEED L IS A CONSTANT, 1)

| | | | NUMBER OF SUB-SCAN FEED | | | | | | | | |
|---|---|---|---|---|---|---|---|---|---|---|---|
| RASTER | @ | Δ | 0 | 1 | 2 | 3 | 4 | 5 | 6 | 7 | 8 |
| 1 | • | – | #14 | | | | | | | | |
| 2 | ↑ | 1 | . | #12 | | | | | | | |
| 3 | ↑ | 1 | . | . | #10 | | | | | | |
| 4 | ↑ | 1 | . | . | . | #8 | | | | | |
| 5 | ↑ | 1 | . | . | . | . | #6 | | | | |
| 6 | ↑ | 1 | . | . | . | . | . | #4 | | | |
| 7 | ↑ | 1 | . | . | . | . | . | . | #2 | | |
| 8 | X | 7 | . | . | . | . | . | . | . | #1 | |
| 9 | • | – | #15 | | | | | | | | |
| 10 | ↑ | 1 | . | #13 | | | | | | | |
| 11 | ↑ | 1 | . | . | #11 | | | | | | |
| 12 | ↑ | 1 | . | . | . | #9 | | | | | |
| 13 | ↑ | 1 | . | . | . | . | #7 | | | | |
| 14 | ↑ | 1 | . | . | . | . | . | #5 | | | |
| 15 | ↑ | 1 | . | . | . | . | . | . | #3 | | |
| 16 | ↑ | 1 | . | . | . | . | . | . | . | #2 | |
| 17 | X | 7 | . | . | . | . | . | . | . | . | #0 |
| 18 | • | – | . | #14 | | | | | | | |
| 19 | ↑ | 1 | . | . | #12 | | | | | | |
| 20 | ↑ | 1 | . | . | . | #10 | | | | | |
| 21 | ↑ | 1 | . | . | . | . | #8 | | | | |
| 22 | ↑ | 1 | . | . | . | . | . | #6 | | | |
| 23 | ↑ | 1 | . | . | . | . | . | . | #4 | | |

Fig. 27

NOZZLE PITCH k AND DESIRABLE SUB-SCAN FEED OFFSET G

| NOZZLE PITCH k [dots] | PREFERABLE SUB-SCAN FEED OFFSET G |
|---|---|
| 8 | 3, 5 |
| 12 | 5, 7 |
| 16 | 3, 5, 7, 9. 11, 13 |

THIRD SCANNING SCHEME

Fig. 28(A) SCAN PARAMETERS

NOZZLE PITCH k : 8 [dot]
NUMBER OF NOZZLES N : 16
NUMBER OF SCAN REPEATS s : 1
NUMBER OF EFFECTIVE NOZZLES Neff : 16

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 19 | 11 | 19 | 19 | 11 | 19 | 11 | 19 |
| Σ L | 0 | 19 | 30 | 49 | 68 | 79 | 98 | 109 | 118 |
| F = (Σ L) % k | 0 | 3 | 6 | 1 | 4 | 7 | 2 | 5 | 0 |
| G = L % k | 0 | 3 | 3 | 3 | 3 | 3 | 3 | 3 | 3 |

Fig. 28(B) RASTER NUMBERS OF EFFECTIVE RASTER LINES RECORDED BY RESPECTIVE NOZZLES

NUMBER OF SUB-SCAN FEED

| NOZZLE | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| # 0: | . | . | . | . | . | . | . | 8 | 27 | 46 | 57 | 76 | 95 | 106 | 125 | (136) |
| # 1: | . | . | . | . | . | . | 5 | 16 | 35 | 54 | 65 | 84 | 103 | 114 | (133) | |
| # 2: | . | . | . | . | . | . | 13 | 24 | 43 | 62 | 73 | 92 | 111 | 122 | (141) | |
| # 3: | . | . | . | . | . | 2 | 21 | 32 | 51 | 70 | 81 | 100 | 119 | (130) | | |
| # 4: | . | . | . | . | . | 10 | 29 | 40 | 59 | 78 | 89 | 108 | 127 | (138) | | |
| # 5: | . | . | . | . | 7 | 18 | 37 | 48 | 67 | 86 | 97 | 116 | (135) | | | |
| # 6: | . | . | . | . | 15 | 26 | 45 | 56 | 75 | 94 | 105 | 124 | (143) | | | |
| # 7: | . | . | . | 4 | 23 | 34 | 53 | 64 | 83 | 102 | 113 | (132) | | | | |
| # 8: | . | . | . | 12 | 31 | 42 | 61 | 72 | 91 | 110 | 121 | (140) | | | | |
| # 9: | . | . | 1 | 20 | 39 | 50 | 69 | 80 | 99 | 118 | (129) | | | | | |
| #10: | . | . | 9 | 28 | 47 | 58 | 77 | 88 | 107 | 126 | (137) | | | | | |
| #11: | . | 6 | 17 | 36 | 55 | 66 | 85 | 96 | 115 | (134) | | | | | | |
| #12: | . | 14 | 25 | 44 | 63 | 74 | 93 | 104 | 123 | (142) | | | | | | |
| #13: | 3 | 22 | 33 | 52 | 71 | 82 | 101 | 112 | (131) | | | | | | | |
| #14: | 11 | 30 | 41 | 60 | 79 | 90 | 109 | 120 | (139) | | | | | | | |
| #15: | 19 | 38 | 49 | 68 | 87 | 98 | 117 | 128 | (147) | | | | | | | |

Fig. 29

RASTER NUMBERS OF EFFECTIVE RASTER LINES RECORDED BY RESPECTIVE NOZZLES
(THIRD SCANNING SCHEME)

| | | | NUMBER OF SUB-SCAN FEED | | | | | | | | |
|---|---|---|---|---|---|---|---|---|---|---|---|
| NOZZLE | @ | Δ | 0 | 1 | 2 | 3 | 4 | 5 | 6 | 7 | 8 |
| 1 | • | – | . | . | #9 | | | | | | |
| 2 | X | 5 | . | . | . | . | . | #3 | | | |
| 3 | • | – | #13 | | | | | | | | |
| 4 | ↑ | 3 | . | . | . | #7 | | | | | |
| 5 | X | 5 | . | . | . | . | . | . | #1 | | |
| 6 | • | – | . | #11 | | | | | | | |
| 7 | ↑ | 3 | . | . | . | . | #5 | | | | |
| 8 | X | 5 | . | . | . | . | . | . | . | #0 | |
| 9 | • | – | . | . | #10 | | | | | | |
| 10 | X | 5 | . | . | . | . | . | #4 | | | |
| 11 | • | – | #14 | | | | | | | | |
| 12 | ↑ | 3 | . | . | . | #8 | | | | | |
| 13 | X | 5 | . | . | . | . | . | . | #2 | | |
| 14 | • | – | . | #12 | | | | | | | |
| 15 | ↑ | 3 | . | . | . | . | #6 | | | | |
| 16 | X | 5 | . | . | . | . | . | . | . | #1 | |
| 17 | • | – | . | . | #11 | | | | | | |
| 18 | X | 5 | . | . | . | . | . | #5 | | | |
| 19 | • | – | #15 | | | | | | | | |
| 20 | ↑ | 3 | . | . | . | #9 | | | | | |
| 21 | X | 5 | . | . | . | . | . | . | #3 | | |
| 22 | • | – | . | #13 | | | | | | | |
| 23 | ↑ | 3 | . | . | . | . | #7 | | | | |
| 24 | X | 5 | . | . | . | . | . | . | . | #2 | |
| 25 | • | – | . | . | #12 | | | | | | |
| 26 | ↑ | 3 | . | . | . | . | . | #6 | | | |
| 27 | X | 5 | . | . | . | . | . | . | . | . | #0 |
| 28 | • | – | . | . | . | #10 | | | | | |
| 29 | X | 5 | . | . | . | . | . | . | #4 | | |
| 30 | • | – | . | #14 | | | | | | | |
| 31 | ↑ | 3 | . | . | . | . | #8 | | | | |
| 32 | X | | . | . | . | . | . | . | . | #3 | |

Fig. 30

SCAN PARAMETERS OF FOURTH SCANNING SCHEME

NOZZLE PITCH k : 8 [dot]
NUMBER OF NOZZLES N : 32
NUMBER OF SCAN REPEATS s : 2
NUMBER OF EFFECTIVE NOZZLES Neff : 16 (=N/s)

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 19 | 11 | 19 | 19 | 11 | 19 | 11 | 19 |
| Σ L | 0 | 19 | 30 | 49 | 68 | 79 | 98 | 109 | 118 |
| F = (Σ L) % k | 0 | 3 | 6 | 1 | 4 | 7 | 2 | 5 | 0 |
| G = L % k | 0 | 3 | 3 | 3 | 3 | 3 | 3 | 3 | 3 |

NUMBER OF SUB-SCAN FEED

| NOZZLE | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| # 0: | . | . | . | . | . | . | . | . | . | . | . | . | . | . | . | -8 | -27 | -46 | -57 | -76 | -95 | -106 | -125 | -(136) |
| # 1: | . | . | . | . | . | . | . | . | . | . | . | . | . | . | -5 | -16 | -35 | -54 | -65 | -84 | -103 | -114 | -(133) | |
| # 2: | . | . | . | . | . | . | . | . | . | . | . | . | . | . | -13 | -24 | -43 | -62 | -73 | -92 | -111 | -122 | -(141) | |
| # 3: | . | . | . | . | . | . | . | . | . | . | . | . | . | -2 | -21 | -32 | -51 | -70 | -81 | -100 | -119 | -(130) | | |
| # 4: | . | . | . | . | . | . | . | . | . | . | . | . | . | -10 | -29 | -40 | -59 | -78 | -89 | -108 | -127 | -(138) | | |
| # 5: | . | . | . | . | . | . | . | . | . | . | . | . | -7 | -18 | -37 | -48 | -67 | -86 | -97 | -116 | -(135) | | | |
| # 6: | . | . | . | . | . | . | . | . | . | . | . | . | -15 | -26 | -45 | -56 | -75 | -94 | -105 | -124 | -(143) | | | |
| # 7: | . | . | . | . | . | . | . | . | . | . | . | -4 | -23 | -34 | -53 | -64 | -83 | -102 | -113 | -(132) | | | | |
| # 8: | . | . | . | . | . | . | . | . | . | . | . | -12 | -31 | -42 | -61 | -72 | -91 | -110 | -121 | -(140) | | | | |
| # 9: | . | . | . | . | . | . | . | . | . | . | -1 | -20 | -39 | -50 | -69 | -80 | -99 | -118 | -(129) | | | | | |
| #10: | . | . | . | . | . | . | . | . | . | . | -9 | -28 | -47 | -58 | -77 | -88 | -107 | -126 | -(137) | | | | | |
| #11: | . | . | . | . | . | . | . | . | . | -6 | -17 | -36 | -55 | -66 | -85 | -96 | -115 | -(134) | | | | | | |
| #12: | . | . | . | . | . | . | . | . | . | -14 | -25 | -44 | -63 | -74 | -93 | -104 | -123 | -(142) | | | | | | |
| #13: | . | . | . | . | . | . | . | . | -3 | -22 | -33 | -52 | -71 | -82 | -101 | -112 | -(131) | | | | | | | |
| #14: | . | . | . | . | . | . | . | . | -11 | -30 | -41 | -60 | -79 | -90 | -109 | -120 | -(139) | | | | | | | |
| #15: | . | . | . | . | . | . | . | . | -19 | -38 | -49 | -68 | -87 | -98 | -117 | -128 | -(147) | | | | | | | |
| #16: | . | . | . | . | . | . | . | 8 | 27 | 46 | 57 | 76 | 95 | 106 | 125 | (136) | | | | | | | | |
| #17: | . | . | . | . | . | . | 5 | 16 | 35 | 54 | 65 | 84 | 103 | 114 | (133) | | | | | | | | | |
| #18: | . | . | . | . | . | . | 13 | 24 | 43 | 62 | 73 | 92 | 111 | 122 | (141) | | | | | | | | | |
| #19: | . | . | . | . | . | 2 | 21 | 32 | 51 | 70 | 81 | 100 | 119 | (130) | | | | | | | | | | |
| #20: | . | . | . | . | . | 10 | 29 | 40 | 59 | 78 | 89 | 108 | 127 | (138) | | | | | | | | | | |
| #21: | . | . | . | . | 7 | 18 | 37 | 48 | 67 | 86 | 97 | 116 | (135) | | | | | | | | | | | |
| #22: | . | . | . | . | 15 | 26 | 45 | 56 | 75 | 94 | 105 | 124 | (143) | | | | | | | | | | | |
| #23: | . | . | . | 4 | 23 | 34 | 53 | 64 | 83 | 102 | 113 | (132) | | | | | | | | | | | | |
| #24: | . | . | . | 12 | 31 | 42 | 61 | 72 | 91 | 110 | 121 | (140) | | | | | | | | | | | | |
| #25: | . | . | 1 | 20 | 39 | 50 | 69 | 80 | 99 | 118 | (129) | | | | | | | | | | | | | |
| #26: | . | . | 9 | 28 | 47 | 58 | 77 | 88 | 107 | 126 | (137) | | | | | | | | | | | | | |
| #27: | . | 6 | 17 | 36 | 55 | 66 | 85 | 96 | 115 | (134) | | | | | | | | | | | | | | |
| #28: | . | 14 | 25 | 44 | 63 | 74 | 93 | 104 | 123 | (142) | | | | | | | | | | | | | | |
| #29: | 3 | 22 | 33 | 52 | 71 | 82 | 101 | 112 | (131) | | | | | | | | | | | | | | | |
| #30: | 11 | 30 | 41 | 60 | 79 | 90 | 109 | 120 | (139) | | | | | | | | | | | | | | | |
| #31: | 19 | 38 | 49 | 68 | 87 | 98 | 117 | 128 | (147) | | | | | | | | | | | | | | | |

Fig. 31

Fig. 32

RASTER NUMBERS OF EFFECTIVE RASTER LINES RECORDED BY RESPECTIVE NOZZLES
(FOURTH SCANNING SCHEME)

| | | | NUMBER OF SUB-SCAN FEED | | | | | | | | | | | | | | | |
|---|---|---|---|---|---|---|---|---|---|---|---|---|---|---|---|---|---|---|
| NOZZLE | @ | Δ | 0 | 1 | 2 | 3 | 4 | 5 | 6 | 7 | 8 | 9 | 10 | 11 | 12 | 13 | 14 | 15 | 16 |
| 1 | • | – | . | . | #25 | . | . | . | . | . | . | . | –#9 | | | | | | |
| 2 | X | 5 | . | . | . | . | . | #19 | . | . | . | . | . | . | . | –#3 | | | |
| 3 | • | – | #29 | . | . | . | . | . | . | . | –#13 | | | | | | | | |
| 4 | ↑ | 3 | . | . | . | #23 | . | . | . | . | . | . | . | –#7 | | | | | |
| 5 | X | 5 | . | . | . | . | . | . | #17 | . | . | . | . | . | . | . | –#1 | | |
| 6 | • | – | . | #27 | . | . | . | . | . | . | . | –#11 | | | | | | | |
| 7 | ↑ | 3 | . | . | . | . | #21 | . | . | . | . | . | . | . | –#5 | | | | |
| 8 | X | 5 | . | . | . | . | . | . | . | #16 | . | . | . | . | . | . | . | –#0 | |
| 9 | • | – | . | . | #26 | . | . | . | . | . | . | . | –#10 | | | | | | |
| 10 | X | 5 | . | . | . | . | . | #20 | . | . | . | . | . | . | . | –#4 | | | |
| 11 | • | – | #30 | . | . | . | . | . | . | . | –#14 | | | | | | | | |
| 12 | ↑ | 3 | . | . | . | #24 | . | . | . | . | . | . | . | –#8 | | | | | |
| 13 | X | 5 | . | . | . | . | . | . | #18 | . | . | . | . | . | . | . | –#2 | | |
| 14 | • | – | . | #28 | . | . | . | . | . | . | . | –#12 | | | | | | | |
| 15 | ↑ | 3 | . | . | . | . | #22 | . | . | . | . | . | . | . | –#6 | | | | |
| 16 | X | 5 | . | . | . | . | . | . | . | #17 | . | . | . | . | . | . | . | –#1 | |
| 17 | • | – | . | . | #27 | . | . | . | . | . | . | . | –#11 | | | | | | |
| 18 | X | 5 | . | . | . | . | . | #21 | . | . | . | . | . | . | . | –#5 | | | |
| 19 | • | – | #31 | . | . | . | . | . | . | . | –#15 | | | | | | | | |
| 20 | ↑ | 3 | . | . | . | #25 | . | . | . | . | . | . | . | –#9 | | | | | |
| 21 | X | 5 | . | . | . | . | . | . | #19 | . | . | . | . | . | . | . | –#3 | | |
| 22 | • | – | . | #29 | . | . | . | . | . | . | . | –#13 | | | | | | | |
| 23 | ↑ | 3 | . | . | . | . | #23 | . | . | . | . | . | . | . | –#7 | | | | |
| 24 | X | 5 | . | . | . | . | . | . | . | #18 | . | . | . | . | . | . | . | –#2 | |
| 25 | • | – | . | . | #28 | . | . | . | . | . | . | . | –#12 | | | | | | |
| 26 | ↑ | 3 | . | . | . | . | . | #22 | . | . | . | . | . | . | . | –#6 | | | |
| 27 | X | 5 | . | . | . | . | . | . | . | . | #16 | . | . | . | . | . | . | . | –#0 |
| 28 | • | – | . | . | . | #26 | . | . | . | . | . | . | . | –#10 | | | | | |
| 29 | X | 5 | . | . | . | . | . | . | #20 | . | . | . | . | . | . | . | –#4 | | |
| 30 | • | – | . | #30 | . | . | . | . | . | . | . | –#14 | | | | | | | |
| 31 | ↑ | 3 | . | . | . | . | #24 | . | . | . | . | . | . | . | –#8 | | | | |
| 32 | X | | . | . | . | . | . | . | . | #19 | . | . | . | . | . | . | . | –#3 | |

INK JET PRINTER

BACKGROUND OF THE INVENTION

1. Field of the Invention

The present invention relates to an ink jet printer that produces a multi-value output of a multi-tone image, such as a photographic image.

2. Discussion of the Background

An ink jet printer generally spouts a specific ink from ink jet nozzles on a printing medium to form small dots to execute printing. In a concrete procedure, the following procedure is repeated to execute the printing: executing dot printing while driving in a main scanning direction a nozzle array having a plurality of nozzles arranged in a sub-scanning direction; feeding a paper sheet at a predetermined pitch in the sub-scanning direction; and executing the dot printing again while driving the nozzle array in the main scanning direction.

Print outputs made by the ink jet printer are not restricted to the conventional print of letters, but it is required to print a multi-tone image, such as a photographic image, with a high quality. The ink jet printer has been improved to satisfy such a requirement, thereby attaining higher resolution and enabling the printing with the finer dots. According to a generally used method of producing a multi-value output of a multi-tone image, driving frequency of the ink jet nozzles in the main scanning direction is made approximately twice an ordinary frequency while the driving distance is minutely regulated so as to change the pixel density.

FIG. 1 shows the concept of a conventional multi-value output technique. This example shows dot formation by three-value outputs, based on print image data including four-value tone information. The four-value tone information requires at least 2-bit, and in the example of FIG. 1(*a*), 8-bit (b7-b0) raster byte data constitutes print image data of four pixels. Two-bit combinations for expressing each pixel are (b7,b6), (b5,b4), (b3,b2), and (b1,b0) as shown in FIG. 1(*b*). The 2-bit representing the tone of one pixel expresses three value outputs by assigning the value '00' to no output of dots, '01' and '10' to outputs of one dot, and '11' to an output of adjoining two dots.

In the above conventional ink jet printer, it is required to drive the ink jet nozzles at a driving frequency that is twice an ordinary frequency in order to carry out the multi-value outputs if the main scanning speed is fixed. This requires the higher-speed head driving mechanism, which undesirably increases the required cost. It may be possible to maintain the driving frequency of the head while halving the main scanning speed only in the case of the multi-value outputs. This, however, lowers the throughput of printing to one half and increases the control conditions on the main scanning speed.

Some conventional ink jet printers adopt a printing scheme of fixed-pitch sub-scans, in order to attain high-quality printing. This printing scheme controls the pitch of sheet feed in the sub-scanning direction to be a constant value so that adjoining lines in the sub-scanning direction are formed by the dots spouted from different ink jet nozzles (see U.S. Pat. No. 4,198,642). When sheet feed errors are accumulated under the minute sheet feeding control requirement, the above multi-value outputs tend to cause banding.

The nozzle pitch has been narrowed to enhance the printing resolution, but there is a manufacture limit to simply narrow the nozzle pitch. Accordingly, print heads as shown in FIG. 2 are commercially available, in which plural columns (two columns in this example) of nozzle arrays are arranged apart from each other in the sub-scanning direction to apparently narrow the nozzle pitch (k pitch in the illustrated example). In such conventional print heads, banding due to a positional displacement of the nozzles easily occurs if the head is inclined. The wider distance between the adjoining columns of the nozzle arrays makes the banding (that is, the streak-like pattern formed along the sub-scanning direction) more conspicuous.

In the conventional multi-value output technique, dots are formed consecutively in the transverse direction in the case of three-value outputs. The dot shape accordingly tends to be long from side to side as shown in FIG. 1(*b*). This lowers the image quality due to granularity deterioration, and requires more accurate sheet feed control because the dots do not extend in the vertical direction.

SUMMARY OF THE INVENTION

An object of the present invention is thus to provide an ink jet printer that effectively alleviates the occurrence of banding without requiring complicated control and that ensures high-quality multi-value outputs.

In order to attain at least part of the above object, an ink jet printer according to the present invention comprises: a print head having a plurality of nozzles; a main scan driving unit that drives the print head in a predetermined main scanning direction relative to a printing medium; a sub-scan driving unit that drives and feeds the printing medium in a sub-scanning direction, which is perpendicular to the main scanning direction; a driving unit controller that controls the main scan driving unit and the sub-scan driving unit to position the print head at predetermined locations; a data storage unit that stores print image data including multi-value tone information; and a print head-driving unit that supplies electric power to the print head to jet ink onto the printing medium based on the print image data stored in the data storage unit; the print head including a plurality of nozzle groups, each nozzle group forming dots of substantially identical color, the print head being driven to enable each nozzle group to record all pixels in an effective recording area on the printing medium; wherein the print head-driving unit has a multi-value output mode in which the print head is driven so that the print head can put a plurality of dots having the substantially identical color one upon another at an identical position using the plurality of nozzle groups, to thereby form multi-value dots representing multi-levels.

By superposing a plurality of dots having a substantially identical color one upon another, three or more tone levels can be expressed by one dot.

It is preferable that the print head driving unit puts the plurality of dots having the substantially identical color one upon another so that the multi-value dots is substantially circular. This arrangement effectively prevents the occurrence of banding.

It is further preferable that the plurality of dots having the substantially identical color include a first density dot having a relatively low density and a second density dot having a relatively high density; wherein the multi-levels include a first tone level attained by the first density dot, a second tone level attained by the second density level, and a third tone level attained by superposing the first and second density dots; and wherein the plurality of nozzle groups include at least one nozzle group for each of the first and second density dots, respectively. This arrangement effects to record dots having multi-tone levels with a plurality of different density inks.

It is also preferable that the plurality of nozzle groups include at least two nozzle groups for at least one of the first density dot and the second density dot, the at least two nozzle groups being able to record all the pixels in the effective recording area; and wherein the multi-levels further include a tone level at which the at least nozzle groups are used to superpose a plurality of identical density dots one upon another. Alternatively, the plurality of nozzle groups may include at least two nozzle groups for each of the first density dot and the second density dot, the at least two nozzle groups being able to record all the pixels in the effective recording area; and wherein the multi-levels further include a fourth tone level at which a plurality of the first density dots are laid one upon another and a fifth tone level at which a plurality of the second density dots are laid one upon another.

It is also preferable that the data storage unit includes a plurality of data blocks for an identical ink, each of the plurality of data blocks storing one bit of pixel information of print image data; and wherein the plurality of data blocks are related to the plurality of nozzle groups so that 1-bit print image data in each data block is used as data for the related nozzle group. The supply of 1-bit print image data from each data block to the nozzles in the related nozzle group effectively controls the jetting or non-jetting of nozzles in the nozzle group.

It is preferable that each of the plurality of nozzle groups includes N nozzles (N being a positive integer) arranged at a nozzle interval k (k being a positive integer) in the sub-scanning direction; and wherein when the number of used nozzles in the sub-scanning direction in each nozzle group used for printing is equal to n (n being a positive integer of not greater than N), k and n are prime to each other.

The plurality of nozzle groups may include an even nozzle array and an odd nozzle array, each having N nozzles (N being a positive integer) arranged at a nozzle interval 2k (k being a positive integer) in the sub-scanning direction, and the even and odd nozzle arrays are apart from each other by a predetermined distance in the main scanning direction; and wherein when the number of used nozzles in the sub-scanning direction in each of the even and odd nozzle arrays used for printing is equal to n (n being a positive integer of not greater than N), 2k an n are prime to each other.

If any one of the above relationships between k and n is satisfied, the driving unit controller can feed the medium in a medium-feed operation mode in which a feed amount of the sub-scan driving unit is fixed to n dots.

Alternatively, the driving unit controller may use a combination of a plurality of different values for feed amounts of a plurality of sub-scans. A variety of scanning schemes capable of recording all the pixels with dots are applicable irrespective of whether the nozzle interval and the number of used nozzles are prime to each other or not.

It is preferable that the print head carries out a plurality of ink-droplet jetting operations for the plurality of dots of the substantially identical color, the plurality of operations being carried out in different main scans, respectively. This arrangement makes the interval of the operations for jetting ink droplets to be a period of one main scan or more, thereby preventing a blot of the ink droplet.

A computer readable recording medium according to the present invention is on storing a computer program used in a computer that comprises a print head having a plurality of nozzle groups and a data storage unit, each nozzle group forming dots of a substantially identical color, the data storage unit storing print image data including multi-value tone information, the computer program being used for forming dots on a printing medium with the print head, the computer program causing the computer to implement: a main scan driving function for driving the print head in a predetermined main scanning direction relative to the printing medium; a sub-scan driving function for driving and feeding the printing medium in a sub-scanning direction that is perpendicular to the main scanning direction; a driving unit control function for controlling the main scan driving function and the sub-scan driving function to locate the print head at predetermined positions; and a print head driving function for controlling spout of ink droplets on the printing medium based on the print image data stored in the data storage unit, wherein the print head driving function has a multi-value output mode in which a plurality of dots having the substantially identical color are laid one upon another at an identical position by the plurality of nozzle groups, to thereby form multi-value dots representing multi-levels. When the computer program is executed by the computer, three or more tone levels can be expressed by one dot in a similar manner as in the above ink jet printer.

BRIEF DESCRIPTION OF THE DRAWINGS

FIGS. 8(A) and 8(B) show an arrangement of ink jet nozzles on ink discharge heads 61–64;

FIG. 18 shows the relationship between the tone value, the ink density, and the resulting dot;

FIGS. 19(A) and 19(B) show the fundamental conditions of general scanning schemes when the number of scan repeats s is equal to 1;

FIGS. 20(A) and 20(B) show the fundamental conditions of general scanning schemes when the number of scan repeats s is not less than 2;

FIG. 21 shows a first scanning scheme using a plurality of different sub-scan feed amounts;

FIGS. 22(A) and 22(B) shows scanning parameters and raster numbers of effective raster lines recorded by the respective nozzles in the first scanning scheme;

FIG. 23 shows the nozzle numbers for recording the effective raster lines in the first scanning scheme;

FIGS. 24(A) and 24(B) show scanning parameters and raster numbers of effective raster lines recorded by the respective nozzles in a second scanning scheme using a plurality of different sub-scan feed amounts;

FIG. 25 shows nozzle numbers for recording effective raster lines in the second scanning scheme;

FIG. 26 shows a scanning scheme when an offset G of the sub-scan feed amount L is a constant value;

FIG. 27 shows combinations of a nozzle pitch k with desirable offsets G of the sub-scan feed amount;

FIGS. 28(A) and 28(B) show scanning parameters and raster numbers of effective raster lines recorded by the respective nozzles in a third scanning scheme using a plurality of different sub-scan feed amounts;

FIG. 29 shows nozzle numbers for recording effective raster lines in the third scanning scheme;

FIG. 30 shows scanning parameters in a fourth scanning scheme using a plurality of different sub-scan feed amounts;

FIG. 31 shows raster numbers of effective raster lines recorded by the respective nozzles in the fourth scanning scheme; and FIG. 32 shows nozzle numbers for recording effective raster lines in the fourth scanning scheme.

DETAILED DESCRIPTION OF THE PREFERRED EMBODIMENT

A. Structure of Apparatus

Figure 3:
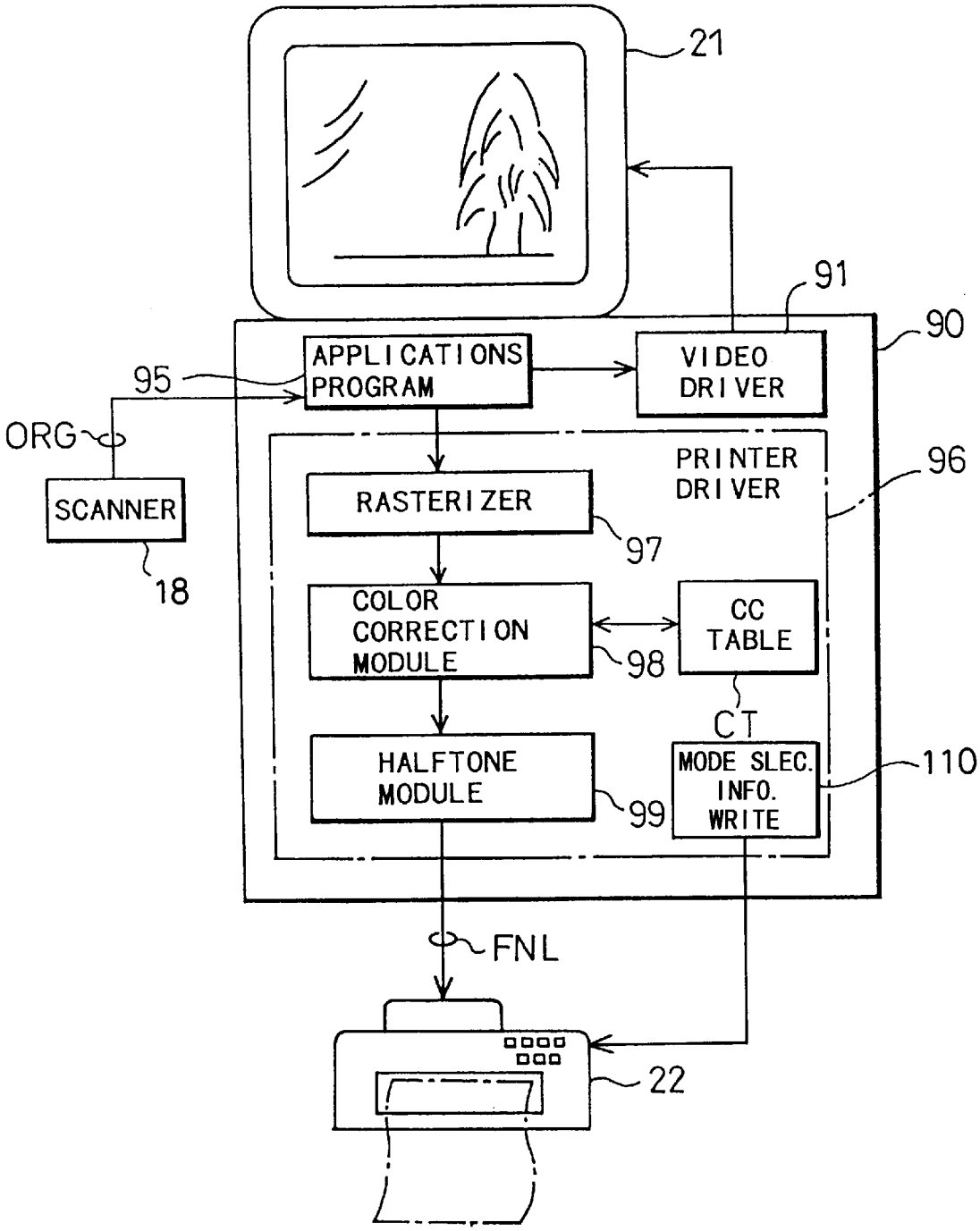
FIG. 3 is a block diagram schematically illustrating the structure of an image processing system applied to the present invention.

FIG. 3 is a block diagram illustrating the structure of a color image processing system embodying the present invention. The color image processing system includes a scanner 18, a personal computer 90, and a color printer 22. The personal computer 90 includes a color display 21. The scanner 18 captures color image data of a color original, and supplies the original color image data ORG, including R, G, and B components, to the computer 90.

Figure 1:
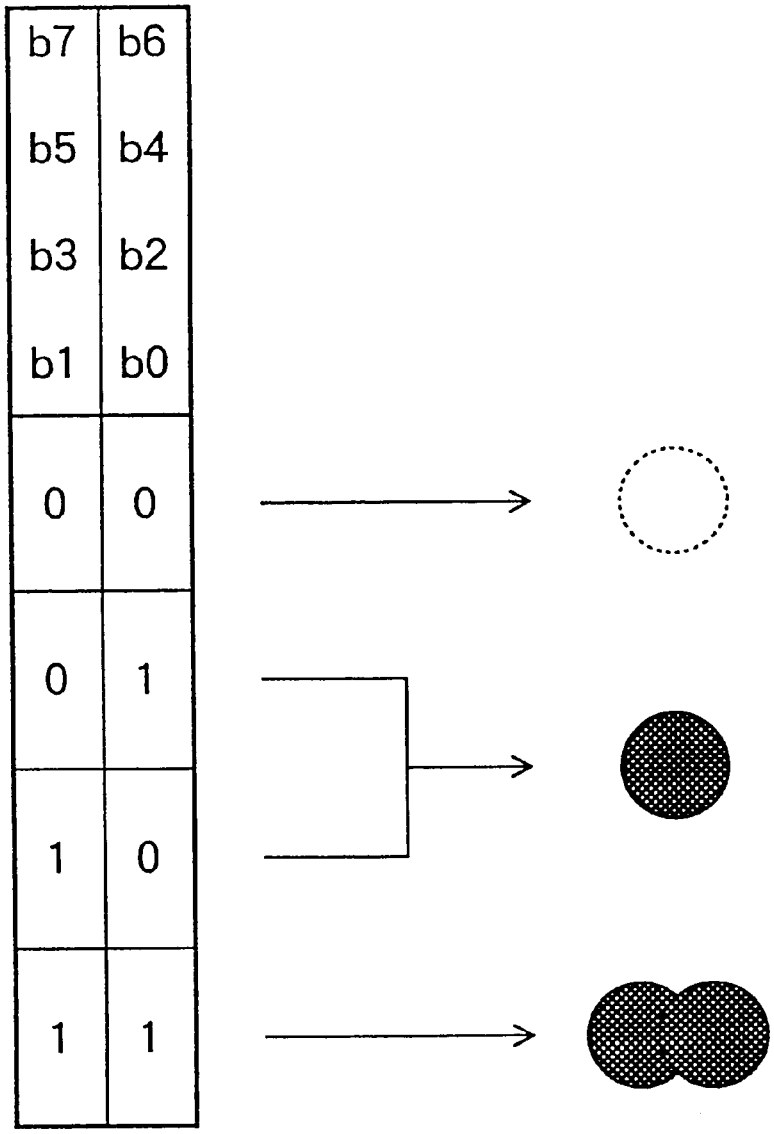
FIGS. 1(*a*) and 1(*b*) show the concept of a conventional multi-value output technique.

The computer 90 is provided therein with CPU, RAM, and ROM (not shown), and an applications program 95 runs under a specific operating system. A video driver 91 and a printer driver 96 are incorporated in the operating system, and final color image data FNL of the applications program 95 are output through these drivers. The applications program 95 used to, for example, retouch an image, reads an image from the scanner, execute a prescribed processing, and displays the image on the CRT display 93 through the video driver 91. When the applications program 95 outputs a printing instruction, the printer driver 96 receives image information from the applications program 95 and converts the input image information to printing signals for the printer 22. (The printing signals are binarized signals for the respective colors of C, M, Y, and K.) In the example of FIG. 1, the printer driver 96 includes: a rasterizer 97 for converting the color image data processed by the applications program 95 to dot-based image data; a color correction module 98 for executing color correction on the dot-based image data according to the ink colors of C, M, and Y used by the printer 22 and the colorimetric characteristics of the printer 22; a color correction table CT referred to by the color correction module 98; a halftone module 99 for generating halftone image data, which represents image density in a particular area by on/off of ink in each dot, from the color-corrected image data; and mode selection writing module 110 for writing mode selection information, which will be described later, into a memory in the color printer 22.

Figure 4:
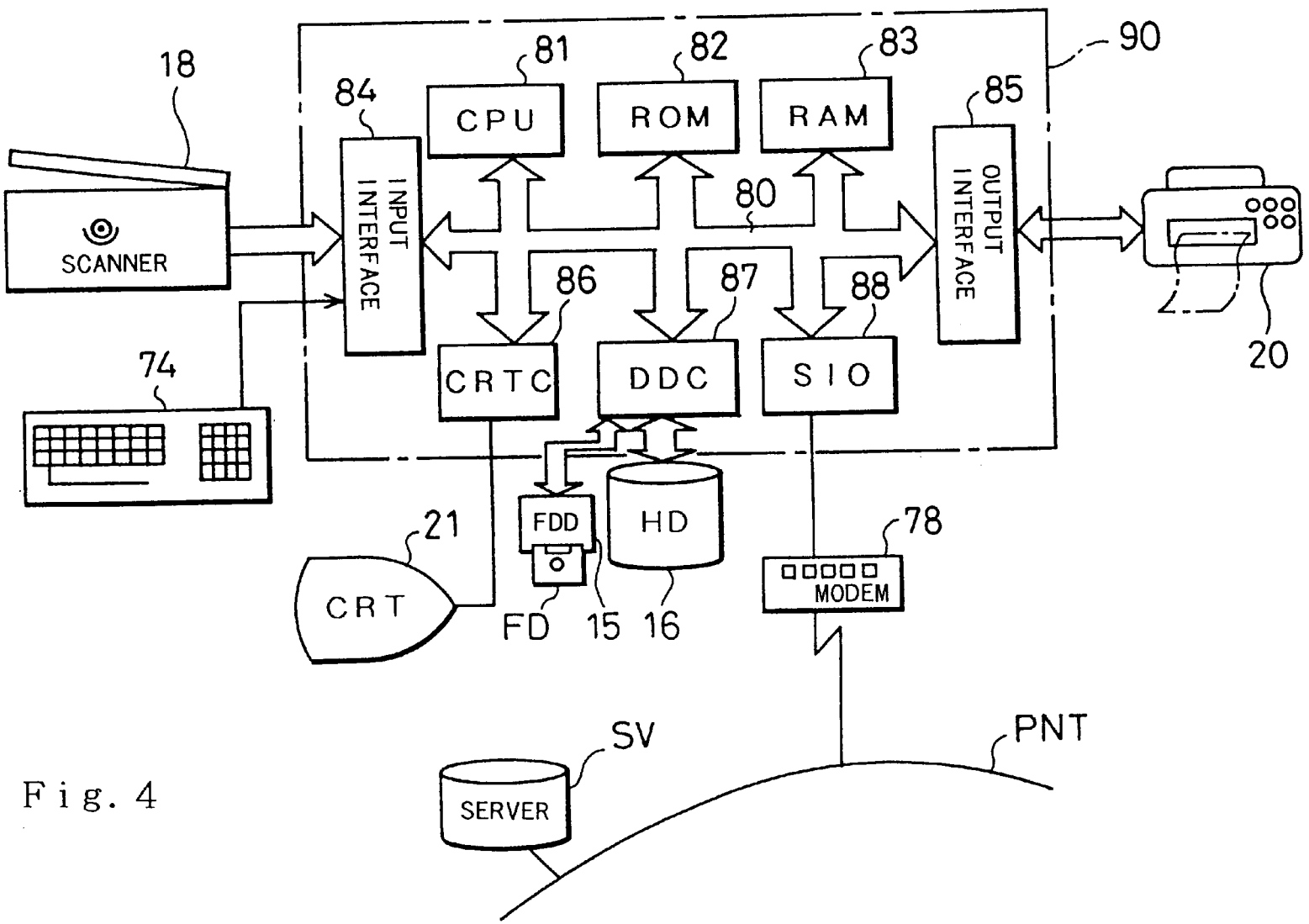
FIG. 4 shows the internal structure of the computer 90 and its connection with a network.

FIG. 4 is a block diagram illustrating the internal structure of the computer 90. The computer 90 includes a CPU 81, which executes a variety of arithmetic and logic operations according to computer programs in order to control operations related to image processing, and the following units mutually connected to one another via a bus 80. A ROM 82 stores computer programs and data required for execution of the variety of arithmetic and logic operations by the CPU 81. A RAM 83 is a memory, which temporarily stores various computer programs and data required for execution of the variety of arithmetic and logic operations by the CPU 81. An input interface 84 receives input signals from the scanner 18 and a keyboard 74, whereas an output interface 85 sends output data to the printer 22. A CRT controller (CRTC) 86 controls signal outputs to a CRT 21 that can display color images. A disk drive controller (DDC) 87 controls transmission of data from and to a hard disk 76, a flexible drive 75, and a CD-ROM drive (not shown). The hard disk 76 stores a variety of computer programs that are loaded into the RAM 83 and executed, as well as other computer programs that are supplied in the form of device drivers. A serial input-output interface (SIO) 88 is also connected to the bus 80. The SIO 88 is connected to a modem 78 and further to a public telephone network PNT via the modem 48. The computer 90 is connected with an external network via the SIO 88 and the modem 78, and can access a specific server SV in order to download the computer programs for image processing into the hard disk 76. The computer 90 may alternatively execute the required programs which have been loaded from a flexible disk FD or a CD-ROM.

Figure 5:
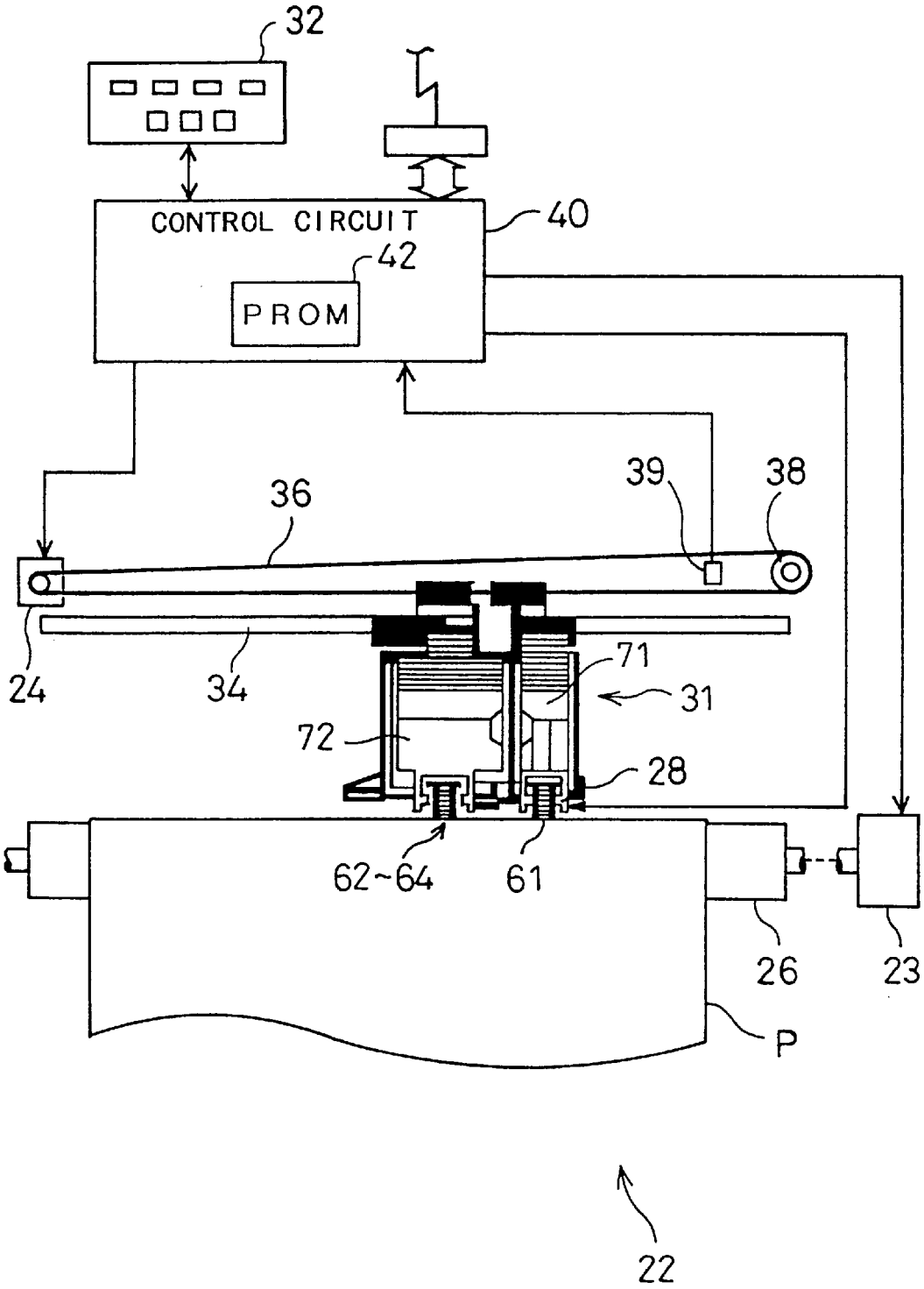
FIG. 5 schematically illustrates the structure of a color printer 22 as an example of the image output apparatus 20.

FIG. 5 schematically illustrates the structure of the printer 22. As shown in the drawing, the printer 22 has a mechanism for feeding a sheet of paper P by means of a sheet feed motor 23, a mechanism for reciprocating a carriage 31 along the axis of a platen 26 by means of a carriage motor 24, a mechanism for driving a print head 28 mounted on the carriage 31 to control discharge of ink and formation of dots, and a control circuit 40 for transmitting signals to and from the sheet feed motor 23, the carriage motor 24, the print head 28, and a control panel 32.

A black ink cartridge 71 and a color ink cartridge 72 for storing plural color inks can be mounted on the carriage 31 of the printer 22. Plural ink discharge heads 61 through 64 are formed on the print head 28 that is disposed in the lower portion of the carriage 31, and ink supply conduits 65 (see FIG. 6) are formed in the bottom portion of the carriage 31 for leading supplies of ink from ink tanks to the respective ink discharge heads 61 through 64. When the black ink cartridge 71 and the color ink cartridge 72 are attached downward to the carriage 31, the ink supply conduits 65 are inserted into connection apertures (not shown) formed in the respective cartridges. This enables supplies of ink to be fed from the respective ink cartridges to the ink discharge heads 61 through 64.

Figure 6:
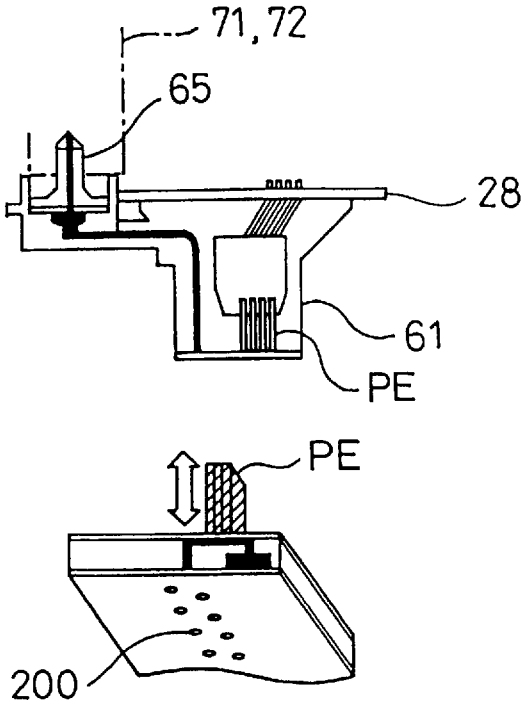
FIG. 6 shows the structure of a print head 28.

The following briefly describes the mechanism of discharging ink. When the ink cartridges 71 and 72 are attached to the carriage 31, inks in the ink cartridges 71 and 72 are sucked out through the ink supply conduits 65 by capillarity and are led to the ink discharge heads 61 through 64 formed in the print head 28 arranged in the lower portion of the carriage 31 as shown in FIG. 6. When the ink cartridges 71 and 72 are attached to the carriage 31, a pump works to suck first supplies of ink into the respective ink discharge heads 61 through 64. In this embodiment, the structures of the pump for suction and a cap for covering the print head 28 during the suction are not illustrated nor described specifically.

Figure 7:
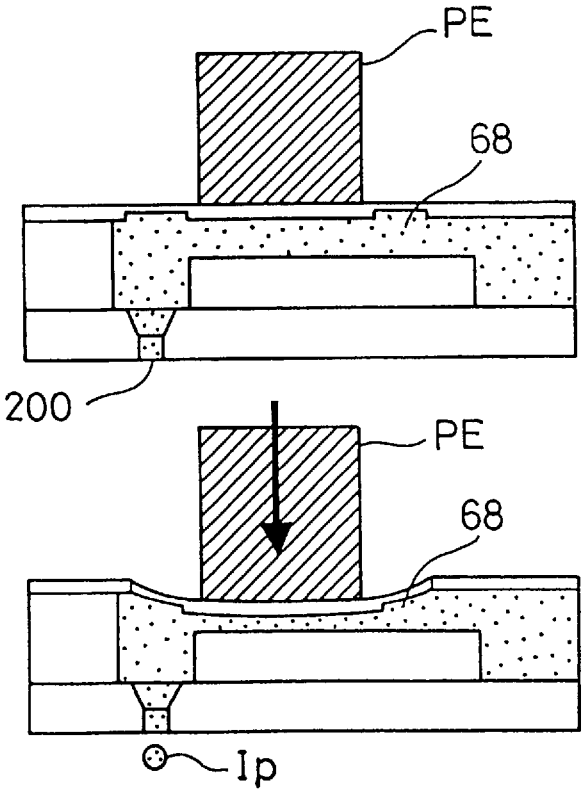
FIG. 7 shows the principle of an ink jetting operation.

An array of thirty-two nozzles 200 is formed in each of the ink discharge heads 61 through 64 as shown in FIG. 6. A piezoelectric element PE, which is one of electrically distorting elements and has an excellent response, is provided for each nozzle 200. FIG. 7 illustrates a configuration of the piezoelectric element PE and the nozzle 200. The piezoelectric element PE is disposed at a position that comes into contact with an ink conduit 80 for leading ink to the nozzle 200. As is known, the piezoelectric element PE has a crystal structure that is subjected to a mechanical stress due to application of a voltage and thereby carries out extremely high-speed conversion of electrical energy to mechanical energy. In this embodiment, application of a voltage between electrodes on either ends of the piezoelectric element PE for a predetermined time period causes the piezoelectric element PE to extend for the predetermined time period and deform one side wall of the ink conduit 80 as shown in the lower part of FIG. 7. The volume of the ink conduit 80 is reduced with an extension of the piezoelectric element PE, and a certain amount of ink corresponding to the reduced volume is sprayed as ink particles Ip from the ends of the nozzle 200 at a high speed. The ink particles Ip soak into the sheet of paper P set on the platen 26, so as to reproduce a print.

In the printer 22 of the embodiment having the hardware structure discussed above, the sheet feed motor 23 rotates the platen 26 and the other related rollers to feed the printing paper P. The carriage motor 24 drives and reciprocates the carriage 31, simultaneously with actuation of the piezoelectric elements PE on the respective ink discharge heads 61 through 64 of the print head 28. The printer 22 accordingly sprays the respective color inks and forms a multi-color image on the printing paper P. Concrete arrangements of the nozzles in the respective ink discharge heads 61 through 64 will be discussed later.

The mechanism for feeding the printing paper P includes a gear train (not shown) for transmitting rotations of the sheet feed motor 23 to the platen 26 as well as a sheet feed roller (not shown). The mechanism for reciprocating the carriage 31 includes a sliding shaft 34 arranged in parallel with the axis of the platen 26 for slidably supporting the carriage 31, a pulley 38, an endless drive belt 36 spanned between the carriage motor 24 and the pulley 38, and a position sensor 39 for detecting the position of the origin of the carriage 31.

The control circuit 40 includes a CPU (not shown), main memories having a ROM and a RAM (not shown), and a programmable ROM (PROM) 42, which is a rewritable non-volatile memory. The PROM 42 stores dot recording mode information including parameters with respect to a plurality of dot recording modes. The "dot recording mode" denotes a scanning scheme defined by the number of actually used nozzles N, the sub-scan feed amount L, and others. In the specification hereof, the terms "scanning scheme" and "recording mode" have substantially the same meanings. Concrete examples of the dot recording modes and their related parameters will be described later. Mode selection information is also stored in the PROM 42 to select a desired mode among the plurality of dot recording modes. For example, when the PROM 42 can store sixteen pieces of dot recording mode information, the mode selection information consists of four-bit data.

The dot recording mode information is read by the printer driver 96 from the PROM 42 when the printer driver 96 (FIG. 3) is installed at the startup of the computer 90. In more concrete terms, the printer driver 96 reads the dot recording mode information corresponding to a desired dot recording mode specified by the mode selection information from the PROM 42. The processes in the rasterizer 97 and the halftone module 99 as well as the main scans and sub-scans are carried out according to the dot recording mode information.

The PROM 42 may be any rewritable non-volatile memory and is, for example, an EEPROM or a flash memory. The dot recording mode information may be stored in a non-rewritable ROM, while it is preferable that the mode selection information is stored in the rewritable non-volatile memory. Plural sets of dot recording mode information may be stored in a storage device other than the PROM 42 or alternatively in the printer driver 96.

FIGS. 8(A) and 8(B) show an arrangement of ink jet nozzles in the ink discharge heads 61 through 64. The first head 61 has a nozzle array for jetting black ink. Similarly the second through the fourth heads 62 through 64 respectively have nozzle arrays for jetting respective inks which are different in color or density. These four nozzle arrays have identical positions in the sub-scanning direction.

Each of the four nozzle arrays includes thirty-two nozzles 200 arranged in a zigzag manner with a constant nozzle pitch k in the sub-scanning direction. The thirty-two nozzle 200 included in each nozzle array may be arranged in alignment, instead of in the zigzag manner. The zigzag arrangement as shown in FIG. 8(A), however, has the advantage of being able to set a smaller nozzle pitch k in the manufacturing process.

FIG. 8(B) shows an arrangement of a plurality of dots formed by one nozzle array. In this embodiment, driving signals are supplied to the piezoelectric elements PE (FIG. 7) of the respective nozzles in order to cause a plurality of dots formed by one nozzle array to be arranged substantially in alignment in the sub-scanning direction, regardless of the arrangement of the ink nozzles; that is, whether the nozzles are arranged in zigzag or in alignment. By way of example, it is assumed that the nozzles are arranged in zigzag as shown in FIG. 8(A) and that the head 61 is scanned rightward in the drawing to form dots. In this case, a group of preceding nozzles 100, 102, . . . receive driving signals at an earlier timing by d/v [second] than a group of following nozzles 101, 103 . . . . Here, d [inch] denotes a pitch between the two nozzle groups in the head 61 (See FIG. 8(A)), and v [inch/second] denotes the scanning speed of the head 61. A plurality of dots formed by one nozzle array are accordingly arranged in alignment in the sub-scanning direction. As described later, all of thirty-two nozzles provided in each of the heads 61 through 64 are not always used, but only part of the nozzles may be used according to the scanning scheme.

The nozzle array in each ink jet head shown in FIG. 8(A) corresponds to the dot forming element array of the present invention. The feeding mechanism of the carriage 31 including the carriage motor 24 shown in FIG. 5 corresponds to the main scan driving unit, and the feeding mechanism of the paper including the sheet feed motor 23 corresponds to the sub-scan driving unit. Moreover, a circuit including the piezoelectric element PE of each nozzle corresponds to the head driving of the present invention. The control circuit 40 and the printer driver 96 (FIG. 3) correspond to the control unit of the present invention.

B. First Embodiment

Figure 9:
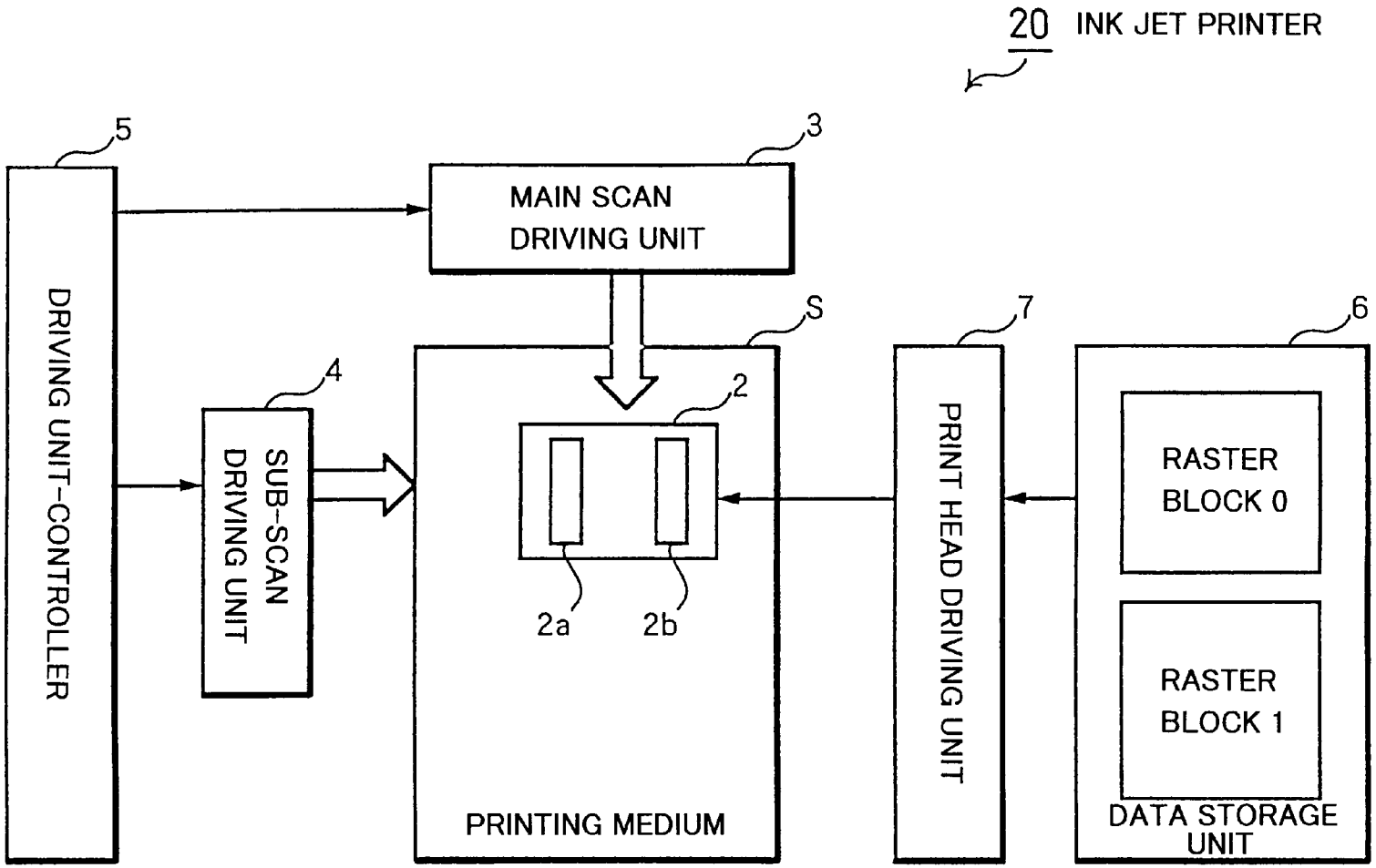
FIG. 9 shows the structure of an ink jet printer in a first embodiment according to the present invention.

FIG. 9 is a functional block diagram of an ink jet printer 20 in a first embodiment according to the present invention. The ink jet printer 20 includes a print head 2, a main scan driving unit 3, a sub-scan driving unit 4, a driving unit controller 5, a data storage unit 6, and a print head driving unit 7. The print head 2 in FIG. 9 corresponds to the print head 28 in FIG. 5, whereas the main scan driving unit 3, the sub-scan driving unit 4, and the print head driving unit 7 respectively correspond to the carriage motor 24, the sheet feed motor 23, and the piezoelectric element PE of FIG. 6. The driving unit controller 5 and the data storage unit 6 correspond to the control circuit 40 in FIG. 5.

Figure 2:
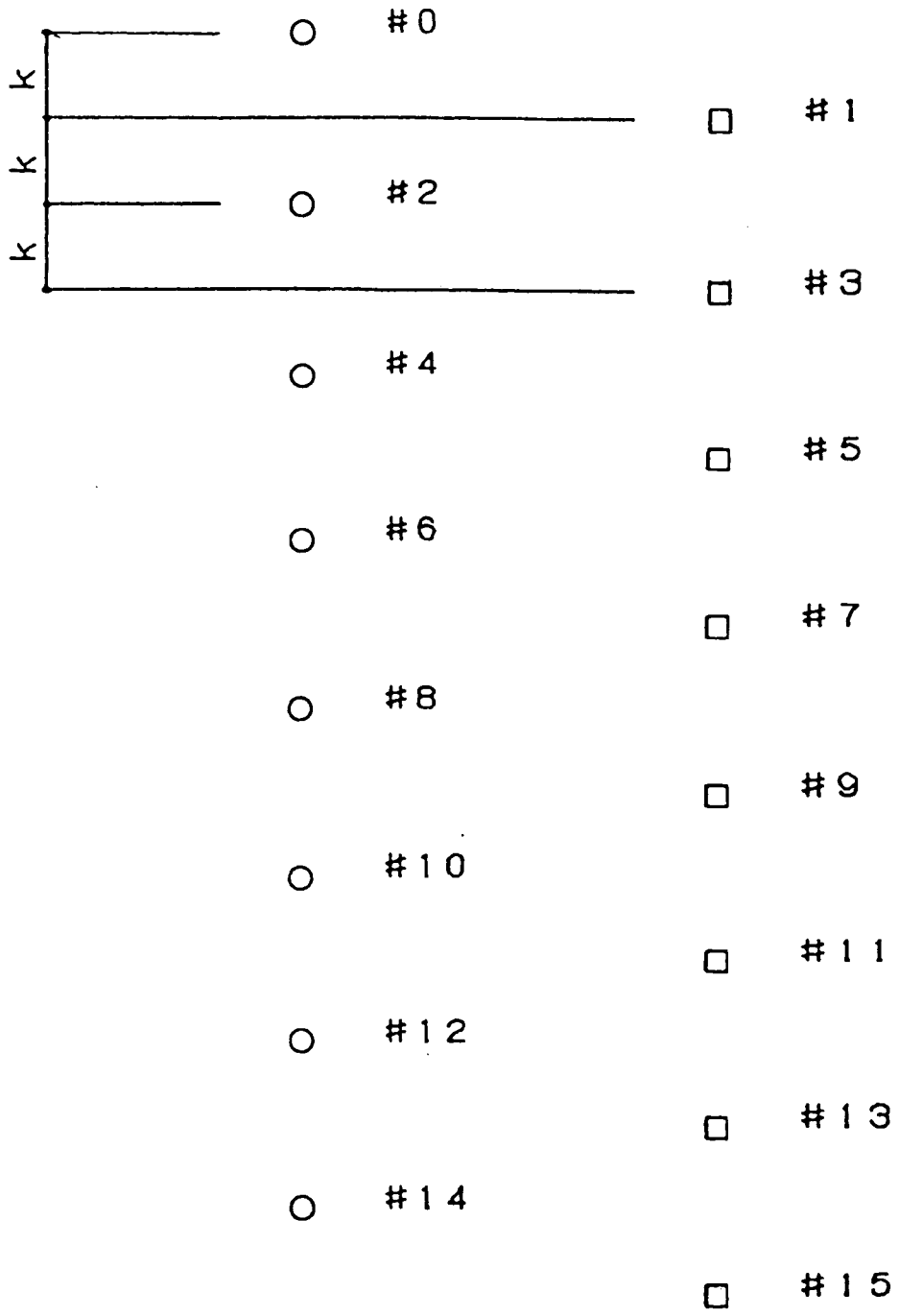
FIG. 2 shows a print head having two nozzle arrays of even and odd arrays in order to effect a narrower pitch.

Like the example shown in FIG. 2, the print head 2 includes an even nozzle array 2*a* and an odd nozzle array 2*b*, which have the nozzle interval 2k (where k is a positive integer) and the number of used nozzles n (seven nozzles are used where N=8 in the example shown in FIG. 2) and are arranged at a predetermined interval in the main scanning direction. When the sub-scan feed amount is a constant value, the nozzle internal 2k and the number of used nozzles n are prime to each other.

The main scan driving unit 3 drives the print head 2 in a predetermined main scanning direction (the transverse direction in the drawing of FIG. 9) relative to a printing medium S, such as a sheet of printing paper. The sub-scan driving unit 4 drives and feeds the printing medium S in a sub-scanning direction (the vertical direction in the drawing of FIG. 9), which is perpendicular to the main scanning direction.

The driving unit controller 5 regulates the driving amounts and the driving timings of the main scan driving unit 3 and the sub-scan driving unit 4, so as to shift the print head 2 in the main scanning direction to predetermined positions. The driving unit controller 5 implements a medium feeding operation mode, in which the feed amount of the printing medium by the sub-scan driving unit 4 is a constant value of n dots, that is, the printing scheme using the fixed-pitch sub-scans described above. An example using non-constant sub-scan feed amounts will be descrived later.

Figure 10:
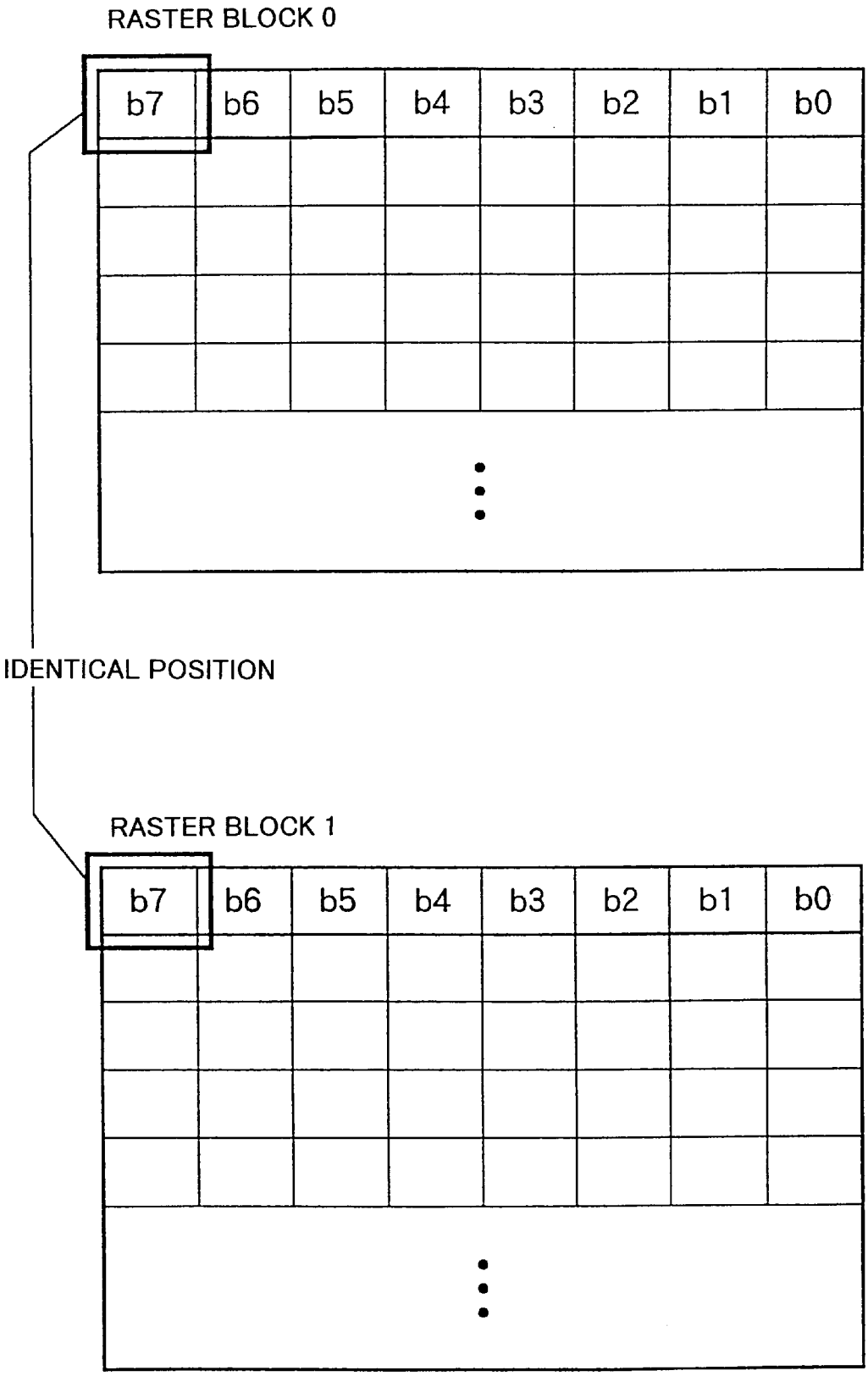
FIG. 10 shows an example of raster blocks in a data storage unit.

The data storage unit 6 has a memory, in which print image data including multi-value tone information is stored. The memory has two data block areas, that is, a raster block 0 and a raster block 1 as shown in FIG. 10. The respective raster blocks 0, 1 have 4-value tone information as the 2-bit combinations for each dot at an identical position. The dot formation data to be output to the even nozzle array 2*a* is stored in the raster block 0, whereas the dot formation data to be output to the odd nozzle array 2*b* is stored in the raster block 1. Like the prior art structure, the ink jet printer 1 of this embodiment expresses three values by the 2-bit information at the corresponding positions in the raster blocks 0, 1.

The print head driving unit 7 supplies electric power to the print head 2, based on the print image data stored in the data storage unit 6, thereby jetting ink from desired nozzles in the even nozzle array 2*a* and the odd nozzle array 2*b* onto the printing medium S.

Figure 11:
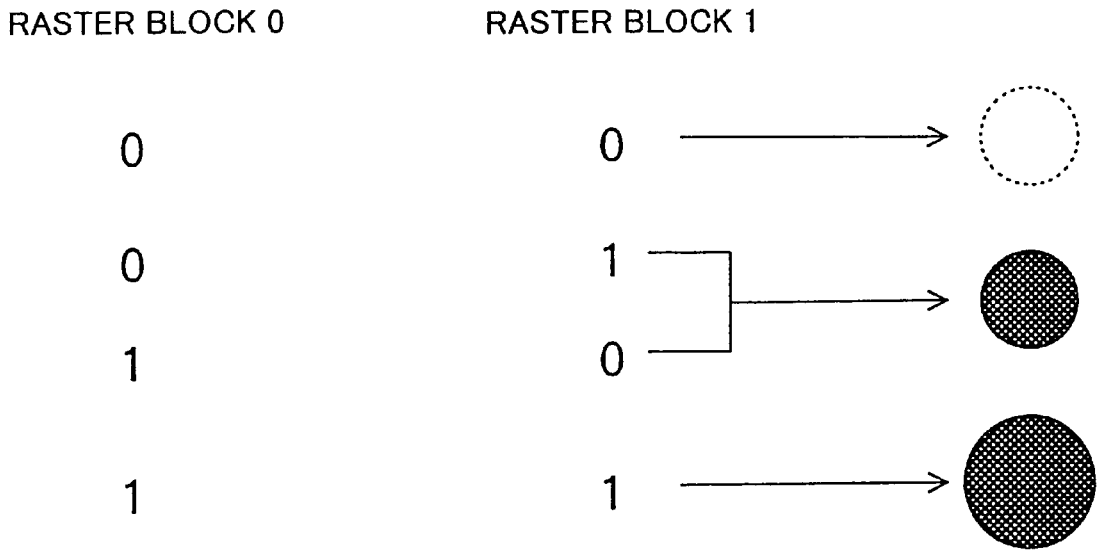
FIG. 11 shows the concept of a multi-value output technique of the embodiment.

As shown in FIG. 11, the multi-value outputs of the ink jet printer 1 of the embodiment include no output of dots when the 2-bit data representing the tone of each dot is equal to '00', and one-dot output by the standard sub-scan control if the 2-bit data is equal to '01' or '10'. If the 2-bit data is equal to '11', the driving unit controller 5 regulates the position of the print head 2 and spouts an ink droplet to overlay a dot on an existing dot, thereby effecting the 3-value output. The dot formed by the 3-value output in this embodiment has a greater diameter than the dot by the 2-value output and a nearly complete round shape.

Figure 12A:
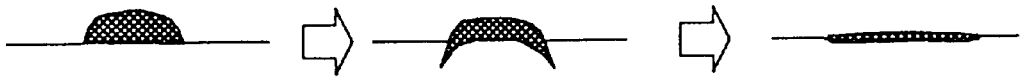
FIG. 12(*a*) shows a process of forming an initial dot according to the multi-value output technique of the embodiment, and FIG. 12(*b*) shows a process of superposing ink upon the existing dot.
Figure 12:
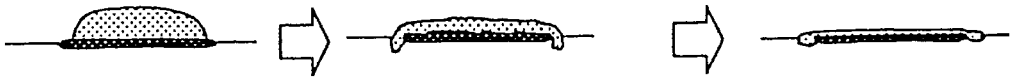

The following describes the details of the 3-value output technique in this embodiment with FIG. 12. As described previously, no ink jetting from a nozzle results in 'dot-less state', and ink jetting results in 'dot-formed state'. In the 'dot-formed state', ink deposited on the printing medium S is gradually soaked into the printing medium S (see FIG. 12(*a*)). When an ink droplet is deposited at the position where a dot has already been formed, the newly deposited ink is soaked around the previously deposited ink to form a larger dot (see FIG. 12(*b*)). This ensures dot formation by the 3-value output.

Figure 13:
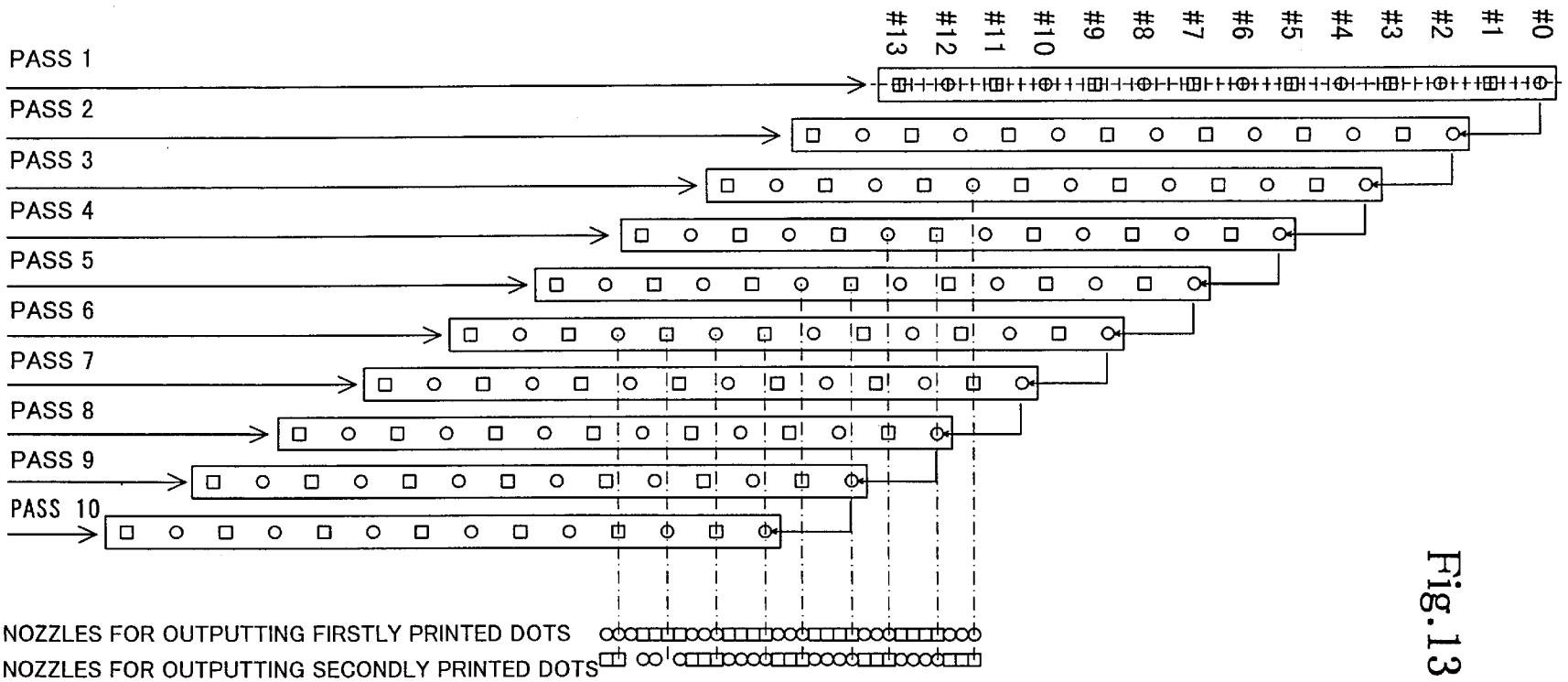
FIG. 13 shows the dot forming positions in a plurality of scanning passes.
Figure 14:
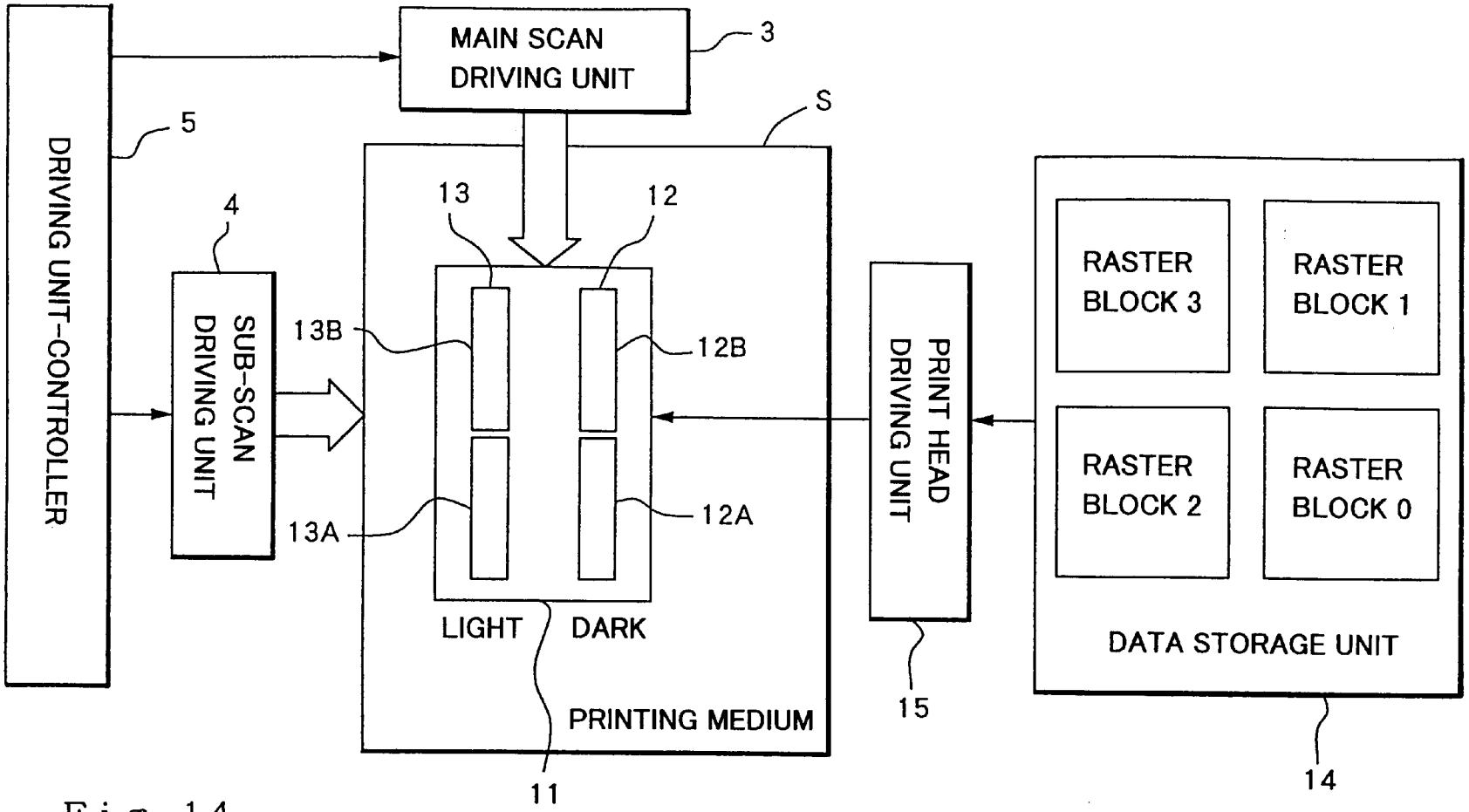
FIG. 14 shows the structure of another ink jet printer in a second embodiment according to the present invention.

An example of the multi-value outputs in this embodiment is described with the drawing of FIG. 13. FIG. 13 shows the dot forming positions in a plurality of scanning passes. In this example, while printing is carried out according to the technique of fixed-pitch sub-scans, the driving unit controller 5 controls to locate the even nozzle array 2*a* and the odd nozzle array 2*b* at predetermined identical positions. In the drawing of FIG. 13, the symbol O denotes dots formed by the even nozzle array, and the symbol □ denotes dots formed by the odd nozzle array 2*b*.

In the example of FIG. 13, the nozzle #8 of the even nozzle array 2*a* in the third main scan pass is located at the same dot forming position as that of the nozzle #1 of the odd nozzle array 2*b* in the seventh main scan pass. Predetermined dots are then formed based on the 2-bit multi-value tone data stored in the raster blocks 0, 1.

As described above, the multi-value output of this embodiment has the same main scanning speed and head frequency as those in the normal operation. Unlike the prior art, this does not increase the cost of the head driving mechanism nor complicates the process of controlling the main scanning speed. The decrease in throughput is substantially equivalent to that when the main scanning speed is halved in the prior art. The dot shapes by the 3-value output in this embodiment is basically a complete round, thereby reproducing high quality resulting images.

In this embodiment, the dot by the 3-value output are all laid one upon another. Even when the inclined print head causes a positional displacement of the nozzles, some overlap is still expected and effectively prevents quality reduction of the resulting image. This means that accumulation of sheet feed errors does not cause much trouble when an identical dot position can be scanned a plurality of times to overlap two dots. This arrangement also ensures 'solid' filling.

As described previously, the arrangement of this embodiment enables printing by the fixed pitch sub-scans in the same manner as the prior art, thereby advantageously giving high-quality prints.

In this embodiment, dots may be superposed to effect the 3-value output with a time difference that is not shorter than the time period required for one scan. This arrangement ensures sufficient drying of the previously formed dot and thereby prevents a blot of ink. Another advantage is the improved dot density by superposing a new dot upon a dried dot.

Although one embodiment of the present invention is described above, the present invention is not restricted to this embodiment in any sense. For example, in the above embodiment, the nozzle array arranged on the print head includes an even nozzle array and an odd nozzle array that mutually interpolate the nozzle interval, and the used nozzles are classified by selecting one every n nozzles in the main scanning direction. Alternatively, the print head may have an arrangement such that nozzle groups each including n (=N) nozzles with a nozzle interval k in the sub-scanning direction are arranged at a fixed interval k in the sub-scanning direction. In the example of FIG. 2 where n is equal to 7, the seven nozzles may be aligned in the sub-scanning direction, like 7 dots of #0–#6 and 7 dots of #7–#13. When the number of used nozzles n is selected among N nozzles in each nozzle group, selection of k and n which are prime to each other enables the superposition of dots of a specific number equal to the number of nozzle groups through identical control.

C. Second Embodiment

A second embodiment of the present invention is described with the drawings of FIGS. 14 through 18. In this embodiment, the like elements of the first embodiment are assigned with the like numerals and not specifically described here. This embodiment is characterized by the structure with two nozzle arrays, that is, a nozzle array for spouting higher-density ink and a nozzle array for spouting lower-density ink, to superpose dots formed by ink droplets of different densities one upon the other at an identical printing position, so as to ensure the richer multi-tone expression.

A print head 11 of this embodiment has a dark color nozzle array 12 for spouting higher-density ink (hereinafter referred to as 'dark color' and shown as 'dark' in the drawings) and a light color nozzle array 13 for spouting lower-density ink (hereinafter referred to as 'light color' and shown as 'light' in the drawings), which are arranged apart from each other by a predetermined interval in the main scanning direction.

The dark color and light color here represent inks that have a practically identical color and different lightness (densities) and are selected for the multi-tone expression, for example, dark cyan and light cyan or dark magenta and light magenta.

In this specification, the plural types of inks having a substantially identical color and different densities are referred to as the 'different density inks'. The plural types of dots that are formed on the printing paper (printing medium) and recognized by the observer to have a substantially identical color but different print densities (reproduction densities) are referred to as the 'different density dots'. The observer generally recognizes the dots that are formed by the same ink but have different diameters to have different print densities. It is accordingly possible to form the 'different density dots' by using the same ink of identical color and density while varying dot diameters.

Each of the nozzle arrays 12 and 13 has a first nozzle group that includes N nozzles arranged at a predetermined nozzle interval in the sub-scanning direction, and a second nozzle group that is arranged apart from the first nozzle group by a predetermined nozzle interval in the sub-scanning direction and includes N nozzles arranged at a predetermined nozzle interval in the sub-scanning direction.

Figure 15:
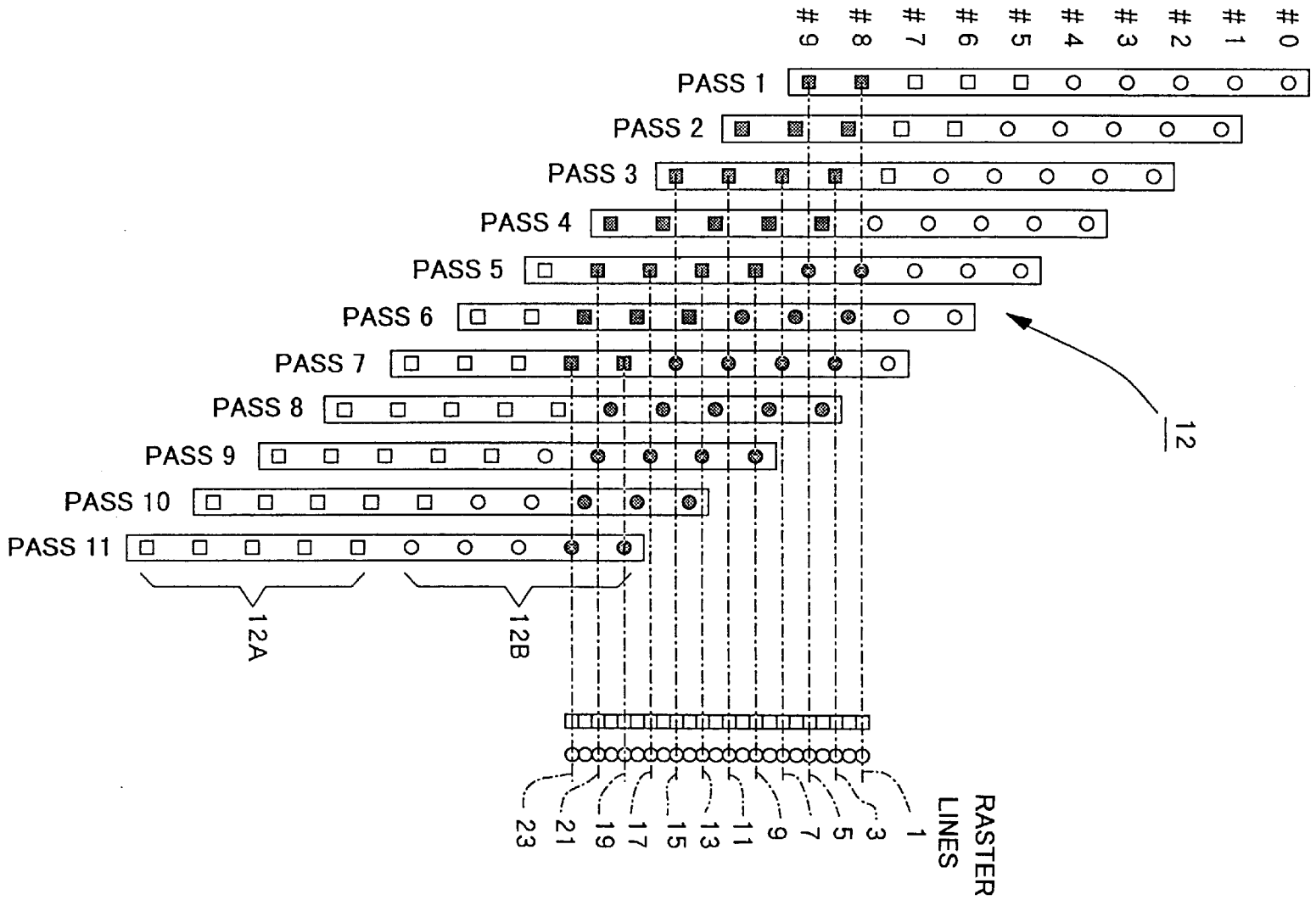
FIG. 15 shows the dot forming positions in a plurality of scanning passes of a dark color nozzle array for jetting a high density ink.

The following describes the arrangement more in detail. As shown in FIG. 15, the dark color nozzle array 12 has a first nozzle group 12A that includes five nozzles #5 to #9 shown by the symbol □ and arranged at a predetermined nozzle interval k in the sub-scanning direction, and a second nozzle group 12B that is apart from the first nozzle group 12A by the predetermined nozzle interval k and includes five nozzles #0 to #4 shown by the symbol O and arranged at the predetermined nozzle interval k in the sub-scanning direction. The dark color ink is spouted from the respective nozzles included in the nozzle groups 12A and 12B based on the print image data.

Figure 16:
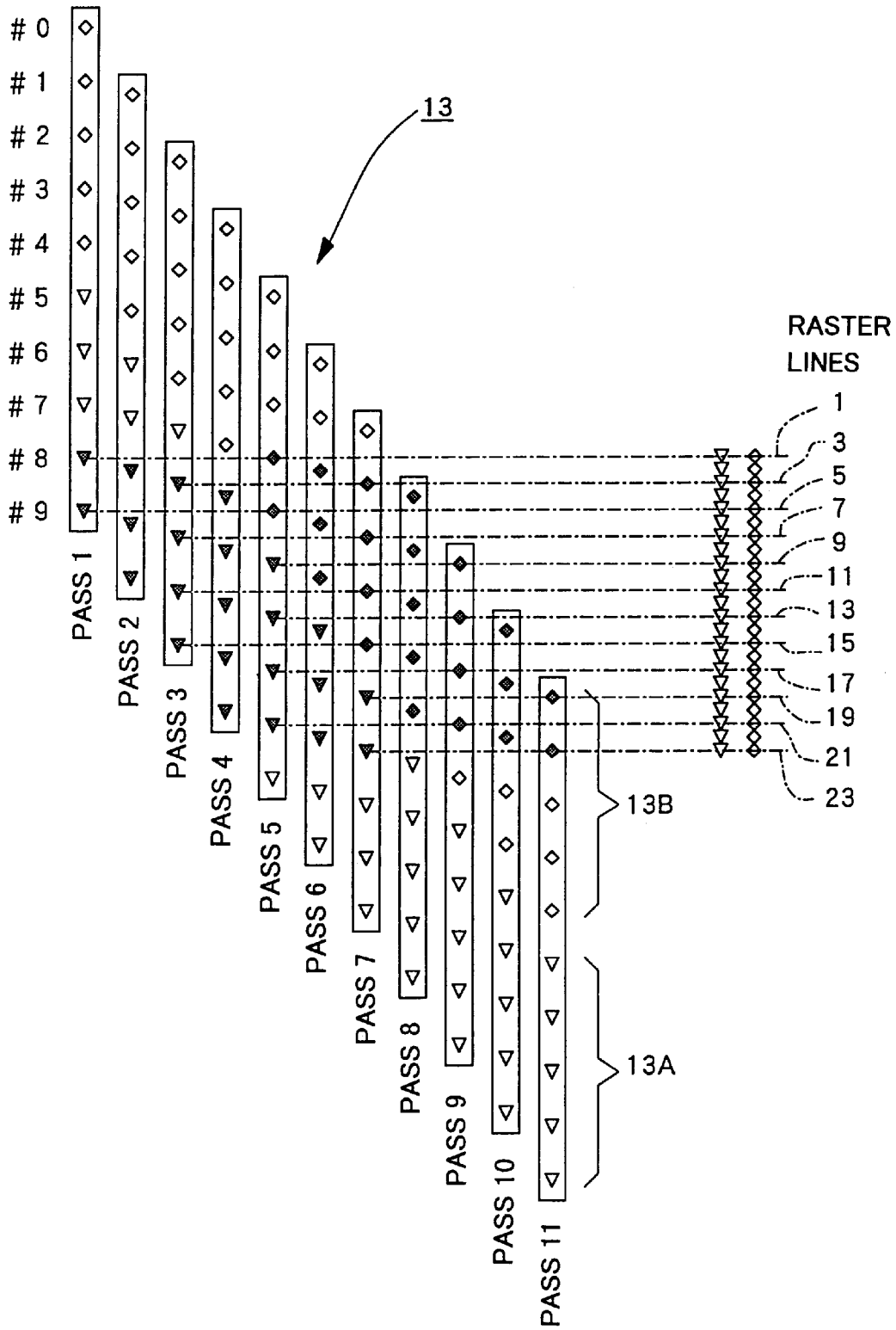
FIG. 16 shows the dot forming positions in a plurality of scanning passes of a light color nozzle array for spouting a low density ink.

In a similar manner, as shown in FIG. 16, the light color nozzle array 13 has a first nozzle group 13A that includes five nozzles #5 to #9 shown by the symbol ▽ and arranged at the predetermined nozzle interval k in the sub-scanning direction, and a second nozzle group 13B that is apart from the first nozzle group 13A by the predetermined nozzle interval k and includes five nozzles #0 to #4 shown by the symbol ◇ and arranged at the predetermined nozzle interval k in the sub-scanning direction. The light color ink is spouted from the respective nozzles included in the nozzle groups 13A and 13B based on the print image data. In FIGS. 15 and 16, the hatched symbols of O, □, ▽, ◇ represent the nozzles that can operate in printing.

In this embodiment, both the total number of nozzles N and the number of used nozzles n are equal to '5', and the values n and k are determined to be prime to each other as described in the first embodiment. For example, k is set equal to '4'. These values N=n=5 and k=4 are only illustrative for the purpose of explanation, and the present invention is not restricted to these values.

Like the data storage unit 6 in the first embodiment, the data storage unit 14 includes a memory, in which print image data including multi-value tone information is stored, and has a plurality of data block areas suitable for the tone information. Since the print head 11 used in this embodiment has the two nozzle arrays 12 and 13 for the dark color and the light color, the data storage unit 14 has four data block areas, that is, raster blocks 0 to 3.

The two raster blocks 0, 1 are assigned to the dark color nozzle array 12. The respective raster blocks 0, 1 represent four-value tone information by the 2 bits each assigned to one dot at an identical position. The 1-bit dot formation data to be output to the first nozzle group 12A is stored in the raster block 0, whereas the 1-bit dot formation data to be output to the second nozzle group 12B is stored in the raster block 1.

When the dot formation data at a particular position in both the raster blocks 0, 1 are equal to '0', no dot is formed at the position. When the dot formation data in the raster block 0 is equal to '1' and the dot formation data in the raster block 1 is equal to '0', only one ink droplet of the dark color hits the printing medium S, thereby forming a dark color dot. When the dot formation data in both the raster blocks 0, 1 are equal to '1', two ink droplets of the dark color hit a substantially identical position at an interval of a preset time period, thereby forming a darker color dot. This means that the 2-bit information at the corresponding positions in the raster blocks 0, 1 enables the expression of the total 3 values: that is, no output of dots, output of one dark color dot, and one overlapped dark color dot.

In a similar manner, the raster blocks 2 and 3, which represent four-value tone information by the 2 bits each assigned to one dot at an identical position, are assigned to the light color nozzle array 13. The 1-bit dot formation data to be output to the first nozzle group 13A is stored in the raster block 2, whereas the 1-bit dot formation data to be output to the second nozzle group 13B is stored in the raster block 3. The 2-bit information at the corresponding positions in the raster blocks 2 and 3 enables the expression of the total 3 values: that is, no output of dots, output of one light color dot, and one overlapped light color dot.

It is also possible to cause the light color nozzle array 13 to overlay a light color dot on a dark color dot which has already been formed by the dark color nozzle array 12. The total of 8-value tones can thus be expressed by the combinations of the superposable dark color dots with the superposable light color dots. In this embodiment, however, 6-value multi-tone expression is applied as described later. The print head driving unit 15 controls the dot outputs of the print head 11 based on the dot formation data stored in these raster blocks 0 to 3.

An exemplified operation of the multi-value outputs by the respective nozzle arrays 12 and 13 are described with FIGS. 15 and 16. FIG. 15 shows the positions where the dark color nozzle array 12 forms dots by a plurality of main scan passes. The print head 11 is controlled by the driving unit controller 14 so that the dot forming positions by the first nozzle group 12A overlap with those by the second nozzle group 12B.

By way of example, the nozzle #8 in the first nozzle group 12A on the pass 1 and the nozzle #3 on the pass 5 are located at an identical dot forming position (raster line 1). As described in the first embodiment, dots are formed based on the 2-bit multi-value tone data stored in the raster blocks 0, 1. In the illustrated example, the overlapping of the dot forming positions (raster lines) occurs at a predetermined pass interval ΔP, that is, once every 4 passes.

As shown by the raster lines 1 to 23, dots can be initially formed on all the raster lines in a printing area by the nozzles in the preceding first nozzle group 12A. The nozzles in the following second nozzle group 12B can subsequently superpose dots upon the initially formed dots. When two nozzle groups, each having a plurality of nozzles arranged at a predetermined nozzle interval k in the sub-scanning direction, are adjoined to each other across the predetermined interval k in the sub-scanning direction, one nozzle group may be referred to as the 'preceding nozzle group' and the other as the 'following nozzle group'.

Referring to FIG. 16, like the dark color nozzle array 12, the light color nozzle array 13 is controlled by the driving-unit controller 5 so that the dot forming positions by the first nozzle group 13A overlap with those by the second nozzle group 13B. In the light color nozzle array 13, dots can be formed first by the first nozzle group 13A and then by the second nozzle group 13B as shown in FIG. 16.

Figure 17:
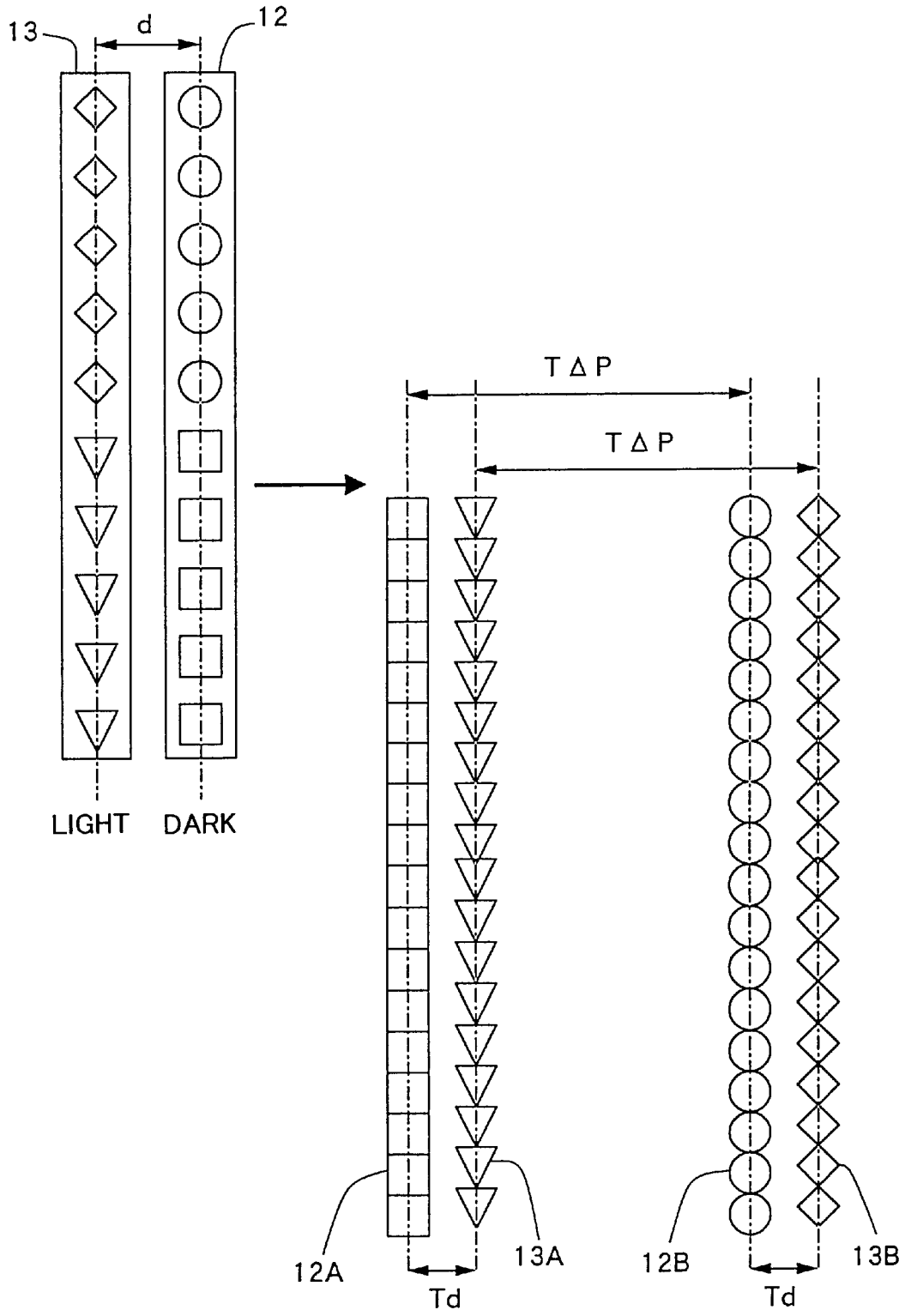
FIG. 17 shows the sequence of forming dark color dots and light color dots.

FIG. 17 shows the sequence of forming dots by the dark color nozzle array 12 and the light color nozzle array 13.

As described above, the first nozzle group can form dots at specific dot forming positions, whereas the second nozzle group of the same nozzle array can form dots at the same dot forming positions after the predetermined pass interval ΔP (ΔP=4 in this embodiment). Referring to FIG. 17, the difference between the time point of dot forming by the preceding first nozzle group and that by the following second nozzle group is equal to a time period TΔP, which depends upon the pass interval ΔP and the main scanning speed. The difference between the time point of dot formation by the corresponding nozzle groups of the different nozzle arrays, on the other hand, is equal to a time period Td, which depends upon a distance d between the nozzle arrays 12 and 13 in the main scanning direction and the main scanning speed.

The sequence of possible dot formation at a specific dot forming position is: preceding dark color dots (□) by the first nozzle group 12A in the dark color nozzle array 12;→preceding light color dots (▽) by the first nozzle group 13A in the light color nozzle array 13;→following dark color dots (O) by the second nozzle group 12B in the dark color nozzle array 12;→following light color dots (◇) by the second nozzle group 13B in the light color nozzle array 13.

This sequence of forming the dark color dots and the light color dots may be utilized to effect, for example, 6-value multi-tone expression. FIG. 18 shows the relationship of: the 6-value tones in the range of 0 to 5, the selected ink densities, the dot formation data stored in the raster blocks, and the conceptual plan view of the dots formed on the printing medium S.

If the tone value is zero, which represents no output of dots at a specific position, the dot formation data '0' is given to the corresponding nozzles in the respective nozzle arrays 12 and 13. No ink droplets are accordingly spouted from either nozzles to form pixels.

If the tone value is 1, only one light color dot (▽) is formed. Either the first nozzle group 13A or the second nozzle group 13B is actuated to spout one ink droplet of the light color, in order to form only one light color dot. It is accordingly sufficient to give the dot formation data '1' to either one of the corresponding nozzles in the respective nozzle groups. By taking into account the case in which a light color dot is superposed as discussed later, however, it is advantageous to give the data '1' to the nozzle in the preceding first nozzle group 13A while giving the data '0' to the corresponding nozzle in the following second nozzle group 13B. Namely the preceding first nozzle group 13A form a light color dot to effect the tone value 1.

If the tone value is 2, another light color dot (◇) is superposed upon the light color dot (▽) formed by the preceding first nozzle group 13A after the predetermined pass interval ΔP. The light color dot formed by the preceding nozzle is sufficiently dried before the elapse of the pass interval ΔP, so that superposing another ink droplet by the following nozzle does not cause a significant blot of the resulting dot. Since a new light color dot is superposed upon the light color dot previously formed after it dried, the density of the resulting dot is increased compared with a single light color dot.

The tone value of 3 is attained by a single dark color dot (□). In the same manner as the case of the tone value of 1, the dot formation data '1' is given to only the nozzle in the preceding first nozzle group 12A. This causes only one ink droplet of the dark color to hit a specified position, so as to effect the tone value 3, which represents the higher density than that of the tone value 2.

The tone value of 4 is attained by superposing a light color dot upon a dark color dot. As discussed with FIG. 17, there are three available methods applicable to superpose a light color dot upon a dark color dot.

The first method first forms a preceding dark color dot (□) by the first nozzle group 12A of the dark color nozzle array 12 and then forms a preceding light color dot (▽) by the first nozzle group 13A of the light color nozzle array 13 (□+▽). The second method first forms a following dark color dot (O) by the second nozzle group 12B of the dark color nozzle array 12 and then forms a following light color dot (◇) by the second nozzle group 13B of the light color nozzle array 13 (O+◇). The third method first forms a preceding dark color dot (□) by the first nozzle group 12A of the dark color nozzle array 12 and then forms a following light color dot (◇) by the second nozzle group 13B of the light color nozzle array 13 (□+◇). In both the first and second methods, the jetting interval between ink droplets is the extremely short time period Td, which depends upon the nozzle array interval d. There is accordingly a possibility that a following dot is formed before the preceding dot is sufficiently dried.

In this embodiment, the third method is applied so that a following dot is superposed upon the preceding dot that has been dried sufficiently. The third method applied to this embodiment effectively prevents an ink blot and increases the density of the resulting dot. Both the first and second methods are, however, included in the technical scope of the present invention.

The tone value of 5 is attained by overlapping two dark color dots each other. In the same manner as the case of the tone value of 2, a following dark color dot is formed after the time period TΔP, which depends upon the pass interval Δ, has elapsed since formation of a preceding dark color dot. This increases the density (tone) of the resulting dot, compared with a single dark color dot.

As described above, the second embodiment enables inks of different densities to be spouted at an identical position so that dots of different densities overlap each other. Compared with the first embodiment, the second embodiment ensures richer tone expression and carries out high-quality printing like a photographic image.

Since the second embodiment can overlap dots at an identical position, like the first embodiment, it ensures formation of a dot having a nearly complete round shape if the accuracy of the main scans and the sub-scans is within a predetermined range. This improves the deterioration of the granularity in the low-density area due to the uneven dot shape. Even when the accuracy of the sub-scans is lowered by the effects of the paper quality or the humidity, the superposed dots tend to grow in the sub-scanning direction, and a white streak (white banding phenomenon) is prevented accordingly. If dots grow in the sub-scanning direction, a decrease in overlapping area of the dots reduces the density at the printed position from the expected density. The growth of the dots in the sub-scanning direction, however, increases the dot formation area. This increase in dot formation area compensates for the reduced density and thereby prevents the printing quality from being lowered.

The structure of making a preceding dot and a following dot overlap each other after the predetermined pass interval ΔP enables a new dot to be superposed upon the dot previously formed and sufficiently dried. This effectively prevents a blot of the resulting dot on the sheet surface while increasing the density of the resulting dot, thereby increasing the amount of ink hit per unit area. This extends the range of tone expression per unit area and improves the degree of freedom of dots in middle tone.

Although the second embodiment is directed to the case where the ink density is classified into two levels, that is, dark and light, the present invention is not restricted to this structure but is applicable to any other structures, for example, one classifying the ink density into three levels, that is, high density, intermediate density, and low density.

In the ink jet printer for color printing, the different density inks may be provided for the four colors, black, cyan, magenta, and yellow, or for the three colors, cyan, magenta, and yellow. Alternatively the different density inks may be provided only for one or a plurality of specific colors. For example, the different density inks may be provided for only cyan and magenta, while the ink of a single density is used for black and yellow.

although the above embodiment uses two nozzle groups for the dark ink and the light ink, the present invention is also applicable to the case in which only one nozzle group is used for the dark ink and the light ink, respectively. This configuration is attained by specifying one of the two nozzle arrays 2*a* and 2*b* for the dark ink and the other for the light ink in the structure of the first embodiment shown in FIG. 9. In this case, the multi-levels expressible by one pixel include a first tone level obtained by one dot of the light ink, a second tone level obtained by one dot of the dark ink, and a third tone level obtained by overlapping dots of the dark ink and the light ink.

The present invention is also applicable to the case in which an identical ink is used to form plural types of different density dots having different sizes, so as to form multi-level dots. In this case, at least one nozzle group is used for each of the plural types of different density dots having different sizes. The different density dots having different sizes can be formed by, for example, a nozzle group of a relatively large diameter and a nozzle group of a relatively small diameter. These dots of different sizes can alternatively be formed by the technique of dot diameter modulation where the dot diameter (that is, the spouted ink droplet) is varied by changing the ink spouting energy to at least one of a plurality of nozzle groups.

D. Method of Sub-Scan Feed

A variety of scanning schemes with a plurality of different sub-scan feed amounts may be applicable to the respective nozzle groups in the first and the second embodiments discussed above. The following describes the fundamental conditions required for the general scanning scheme, prior to the explanation for the variety of scanning schemes applied to the embodiments of the present invention.

FIG. 19 shows the fundamental conditions of the general scanning scheme. FIG. 19(A) shows a sub-scan feed with one nozzle group including four nozzles, and FIG. 19(B) shows the parameters of this scanning scheme. The details of the parameters will be described later. The following description is made for the case in which one nozzle group is used for spouting identical ink. For example, the nozzle group including four nozzles shown in FIG. 19(A) corresponds to either the even nozzle array 2*a* or the odd nozzle array 2*b* of FIG. 9.

FIGS. 19(A) and 19(B) show basic conditions of a general scanning scheme when the number of scan repeats s is equal to one. FIG. 19(A) illustrates an example of sub-scan feeds with five nozzles, and FIG. 19(B) shows parameters of the scanning scheme. In the drawing of FIG. 19(A), solid circles including numerals indicate the positions of the five nozzles in the sub-scanning direction after each sub-scan feed. The encircled numerals 0 through 3 denote the nozzle numbers. The five nozzles are shifted in the sub-scanning direction every time when one main scan is concluded. Actually, however, the sub-scan feed is executed by feeding a printing paper with the sheet feed motor 23 (FIG. 5).

As shown on the left-hand side of FIG. 19(A), the sub-scan feed amount L is fixed to four dots. On every sub-scan feed, the four nozzles are shifted by four dots in the sub-scanning direction. When the number of scan repeats s is equal to one, each nozzle can record all dots (pixels) on the raster line. The right-hand side of FIG. 19(A) shows the nozzle numbers of the nozzles which record dots on the respective raster lines. There are non-serviceable raster lines above or below those raster lines that are drawn by the broken lines, which extend rightward (in the main scanning direction) from a circle representing the position of the nozzle in the sub-scanning direction. Recording of dots is thus prohibited on these raster lines drawn by the broken lines. On the contrary, both the raster lines above and below a raster line that is drawn by the solid line extending in the main scanning direction are recordable with dots. The range in which all dots can be recorded is hereinafter referred to as the "effective record area" (or the "effective print area"). The range in which the nozzles scan but all the dots cannot be recorded are referred to as the "non-effective record area (or the "non-effective print area)". All the area which is scanned with the nozzles (including both the effective record area and the non-effective record area) is referred to as the nozzle scan area.

Various parameters related to the scanning scheme are shown in FIG. 19(B). The parameters of the scanning scheme include the nozzle pitch k [dots], the number of used nozzles n, the number of scan repeats s, number of effective nozzles Neff, and the sub-scan feed amount L [dots]. The nozzle pitch k [dots] indicates how many pitches (dot pitches) in the resulting recorded image correspond to the interval between the center points of the nozzles on the print head. In the example of FIG. 19, k is equal to 3. The number of used nozzles n denotes the number of nozzles actually used for dot formation among all the nozzles mounted on the print head. In the example of FIG. 19, n is equal to 4.

When the nozzles arranged in zigzag (FIG. 2) are divided into the two nozzle groups, that is, the even nozzle group #0, #2, . . . , #14 and the odd nozzle group #1, #3, . . . , #15, as described in the first embodiment, the nozzle pitch 2*k* in each nozzle group shown in FIG. 2 corresponds to the nozzle pitch k in FIG. 19.

The number of scan repeats s indicates how many passes (main scans) are required to fill each main scanning line with dots. The number of scan repeats s also means that dots are formed intermittently once every s dots during one main scan. The number of scan repeats s is accordingly equal to the number of nozzles used for recording all the dots on the respective main scanning lines. In the description hereinafter, the main scanning line is referred to as the 'raster line'. In the example of FIG. 19, s is equal to 1 because each raster line is filled by one pass. As will be described later, when s is equal to or greater than 2, dots are formed intermittently in the main scanning direction. The number of effective nozzles neff is obtained by dividing the number of used nozzles n by the number of scan repeats s. The number of effective nozzles neff may be regarded as the net number of raster lines that can be fully recorded during a single main scan. The meaning of the number of effective nozzles neff will be further discussed later.

The table of FIG. 19(B) shows the sub-scan feed amount L, its accumulated value ΣL, and a nozzle offset F after each sub-scan feed. The offset F is a value indicating the distance in number of dots between the nozzle positions and reference positions of offset 0. The reference positions are presumed to be those periodic positions which include the initial positions of the nozzles where no sub-scan feed has been conducted (every fourth dot in FIG. 19(A)). For example, as shown in FIG. 19(A), a first sub-scan feed moves the nozzles in the sub-scanning direction by the sub-scan feed amount L (4 dots). The nozzle pitch k is 3 dots as mentioned above. The offset F of the nozzles after the first sub-scan feed is accordingly 1 (see FIG. 19(A)). Similarly, the position of the nozzles after the second sub-scan feed is ΣL(=8) dots away from the initial position so that the offset F is 2. The position of the nozzles after the third sub-scan feed is ΣL(=12) dots away from the initial position so that the offset F is 0. Since the third sub-scan feed brings the nozzle offset F back to zero, all dots of the raster lines within the effective record area can be serviced by repeating the cycle of 3 sub-scans.

As will be understood from the above example, when the nozzle position is apart from the initial position by an integral multiple of the nozzle pitch k, the offset F is zero. The offset F is given by (ΣL)%k, where ΣL is the accumulated value of the sub-scan feed amount L, k is the nozzle pitch, and "%" is an operator indicating that the remainder of the division is taken. Viewing the initial position of the nozzles as being periodic, the offset F can be viewed as an amount of phase shift from the initial position.

When the number of scan repeats s is one, the following conditions are required to avoid skipping or overwriting of raster lines in the effective record area:

Condition c1: The number of sub-scan feeds in one feed cycle is equal to the nozzle pitch k.

Condition c2: The nozzle offsets F after the respective sub-scan feeds in one feed cycle assume different values in the range of 0 to (k−1).

Condition c3: Average sub-scan feed amount (ΣL/k) is equal to the number of used nozzles n. In other words, the accumulated value ΣL of the sub-scan feed amount L for the whole feed cycle is equal to a product (n×k) of the number of used nozzles n and the nozzle pitch k.

The above conditions can be understood as follows. Since (k−1) raster lines are present between adjoining nozzles, the number of sub-scan feeds required in one feed cycle is equal to k so that the (k-1) raster lines are serviced during one feed cycle and that the nozzle position returns to the reference position (the position of the offset F equal to zero) after one feed cycle. If the number of sub-scan feeds in one feed cycle is less than k, some raster lines will be skipped. If the number of sub-scan feeds in one feed cycle is greater than k, on the other hand, some raster lines will be overwritten. The first condition c1 is accordingly required.

If the number of sub-scan feeds in one feed cycle is equal to k, there will be no skipping or overwriting of raster lines to be recorded only when the nozzle offsets F after the respective sub-scan feeds in one feed cycle take different values in the range of 0 to (k−1). The second condition c2 is accordingly required.

When the first and the second conditions c1 and c2 are satisfied, each of the n nozzles records k raster lines in one feed cycle. Namely n×k raster lines can be recorded in one feed cycle. When the third condition c3 is satisfied, the nozzle position after one feed cycle (that is, after the k sub-scan feeds) is away from the initial position by the n×k raster lines as shown in FIG. 19(A). Satisfying the above first through the third conditions c1 to c3 thus prevents skipping or overwriting of raster lines to be recorded in the range of n×k raster lines.

FIGS. 20(A) and 20(B) show the basic conditions of a general scanning scheme when the number of scan repeats s is no less than 2. When the number of scan repeats s is 2 or greater, each raster line is recorded with s different nozzles. In the description hereinafter, the scanning scheme adopted when the number of scan repeats s is not less than 2 is referred to as the "overlap scheme".

The scanning scheme shown in FIGS. 20(A) and 20(B) amounts to that obtained by changing the number of scan repeats s and the sub-scan feed amount L among the scanning scheme parameters shown in FIG. 19(B). As will be understood from FIG. 20(A), the sub-scan feed amount L in the scanning scheme of FIGS. 20(A) and 20(B) is a constant value of two dots. In FIG. 20(A), the nozzle positions after the odd-numbered sub-scan feeds are indicated by the diamonds. As shown on the right-hand side of FIG. 20(A), the dot positions recorded after the odd-numbered sub-scan feed are shifted by one dot in the main scanning direction from the dot positions recorded after the even-numbered sub-scan feed. This means that the plurality of dots on each raster line are recorded intermittently by each of two different nozzles. For example, the upper-most raster in the effective record area is intermittently recorded on every other dot by the No. 2 nozzle after the first sub-scan feed and then intermittently recorded on every other dot by the No. 0 nozzle after the fourth sub-scan feed. In the overlap scheme, each nozzle is generally driven at an intermittent timing so that recording is prohibited for (s−1) dots after recording of one dot during a single main scan.

In the overlap scheme, the multiple nozzles used for recording the same raster line are required to record different positions shifted from one another in the main scanning direction. The actual shift of recording positions in the main scanning direction is thus not restricted to the example shown in FIG. 20(A). In one possible scheme, dot recording is executed at the positions indicated by the circles shown in the right-hand side of FIG. 20(A) after the first sub-scan feed, and is executed at the shifted positions indicated by the diamonds after the fourth sub-scan feed.

The lower-most row of the table of FIG. 20(B) shows the values of the offset F after each sub-scan feed in one feed cycle. One feed cycle includes six sub-scan feeds. The offsets F after each of the six sub-scan feeds assume every value between 0 and 2, twice. The variation in the offset F after the first through the third sub-scan feeds is identical with that after the fourth through the sixth sub-scan feeds. As shown on the left-hand side of FIG. 20(A), the six sub-scan feeds included in one feed cycle can be divided into two sets of sub-cycles, each including three sub-scan feeds. One feed cycle of the sub-scan feeds is completed by repeating the sub-cycles s times.

When the number of scan repeats s is an integer of not less than 2, the first through the third conditions c1 to c3 discussed above are rewritten into the following conditions c1' through c3':

Condition c1': The number of sub-scan feeds in one feed cycle is equal to a product (k×s) of the nozzle pitch k and the number of scan repeats s.

Condition c2': The nozzle offsets F after the respective sub-scan feeds in one feed cycle assume every value between 0 to (k−1), s times.

Condition c3': Average sub-scan feed amount $\{\Sigma L/(k\times s)\}$ is equal to the number of effective nozzles neff (=n/s). In other words, the accumulated value ΣL of the sub-scan feed amount L for the whole feed cycle is equal to a product $\{neff\times(k\times s)\}$ of the number of effective nozzles neff and the number of sub-scan feeds (k×s).

The above conditions c1' through c3' hold even when the number of scan repeats s is one. This means that the conditions c1' through c3' generally hold for the scanning scheme irrespective of the number of scan repeats s. When these three conditions c1' through c3' are satisfied, there is no skipping or overwriting of dots recorded in the effective record area. If the overlap scheme is applied (if the number of scan repeats s is not less than 2), the recording positions on the same raster should be shifted from each other in the main scanning direction.

Partial overlapping may be applied for some scanning schemes. In the "partial overlap" scheme, some raster lines are recorded by one nozzle and other raster lines are recorded by multiple nozzles. The number of effective nozzles neff can be also defined in the partial overlap scheme. By way of example, if two nozzles among four used nozzles cooperatively record one identical raster line and each of the other two nozzles records one raster line, the number of effective nozzles neff is 3. The three conditions c1' through c3' discussed above also hold for the partial overlap scheme.

It may be considered that the number of effective nozzles neff indicates the net number of raster lines recordable in a single main scan. For example, when the number of scan repeats s is 2, n raster lines can be recorded by two main scans where n is the number of actually-used nozzles. The net number of raster lines recordable in a single main scan is accordingly equal to n/S (that is, neff). The number of effective nozzles neff in this embodiment corresponds to the number of effective dot forming elements in the present invention.

FIG. 21 shows a first scanning scheme in the embodiment of the present invention. The scan parameters of this scanning scheme are shown in the bottom of FIG. 21, where the nozzle pitch k is equal to 4 dots, the number of used nozzles n is equal to 8, the number of scan repeats s is equal to 1, and the number of effective nozzles neff is equal to 8.

In the example of FIG. 21, nozzle numbers #0 through #7 are allocated to the eight used nozzles from the top. In the first scanning scheme, four sub-scan feeds constitute one cycle, and the amount of the sub-scan feed L is varied in the sequence of 10, 7, 6, and 9 dots. This means that a plurality of different values are used for the sub-scan feed amount L. The positions of the eight nozzles in the respective sub-scan feeds are shown by four different figures. The right end of FIG. 21 shows by which nozzle and after which sub-scan feed the dots on the raster lines in the effective record area are to be recorded. In the first scanning scheme, a non-effective record area of 20 raster lines is present before the effective record area. Namely the effective record area starts at the 21st raster line from the upper end of the nozzle scan area (the range including the effective record area and the non-effective record area). The nozzle position in the first main scan is set to be apart from the upper end of the printing paper by a predetermined distance. The earlier starting position of the effective record area enables the dots to be recorded from the position closer to the upper end of the printing paper.

FIGS. 22(A) and 22(B) show the scan parameters and the raster numbers of the effective raster lines recorded by the respective nozzles in the first scanning scheme. The table of FIG. 22(A) shows the sub-scan feed amount L and its summation ΣL for each sub-scan feed, the offset F of the nozzle after each sub-scan feed, and the offset G of the sub-scan feed amount L. The offset G of the sub-scan feed amount L is the remainder obtained by dividing the sub-scan feed amount L by the nozzle pitch k. The meaning of the offset G of the sub-scan feed amount L will be described later in detail.

The parameters shown in FIG. 22(A) satisfy the three conditions c1' through c3' discussed above. The number of sub-scan feeds in one cycle is equal to the product (k×s=4) of the nozzle pitch k(=4) and the number of scan repeats s(=1) (first condition c1'). The offset F of the nozzle after each sub-scan feed in one cycle assumes the values in the range of 0 to (k−1) (i.e., in the range of 0 to 3) (second condition c2'). The average sub-scan feed amount (ΣL/k) is equal to the number of effective nozzles neff(=8) (third condition c3'). The first scanning scheme accordingly satisfies the fundamental requirement that there is no dropout or overlap of recorded raster lines in the effective recording area.

The first scanning scheme also has the following two features. The first feature is that the nozzle pitch k and the number of used nozzles n are integers which are no less than 2 and which are not relatively prime. The second feature is that a plurality of different values are used for the sub-scan feed amount L. As discussed previously in the prior art, the conventional scanning scheme sets the number of nozzles n and the nozzle pitch k at the integers that are relatively prime. The number of nozzles n actually used among a large number of nozzles provided is thus restricted to the value that is prime to the nozzle pitch k. In other words, the problem of the conventional process is that the nozzles provided are not sufficiently used in many cases. Application of the scanning scheme having the first feature that the nozzle pitch k and the number of used nozzles n are integers which are no less than 2 and which are not relatively prime, on the other hand, advantageously increases the number of used nozzles as many as possible. The second feature allows the fundamental requirement that there is no dropout or overlap of recorded raster lines in the effective record area to be satisfied when the scanning scheme has the first feature. There will be dropout or overlap of raster lines if the scanning scheme that has the first feature and a fixed sub-scan feed amount L is applied.

The scanning scheme using a plurality of different sub-scan feed amounts is applicable not only to the case in which the nozzle pitch k and the number of used nozzles n are integers of not less than 2 that are not relatively prime, but to the case in which the nozzle pitch k and the number of used nozzles n are prime to each other.

FIG. 22(B) shows the raster numbers of the effective raster lines recorded by the respective nozzles in the main scan after each sub-scan feed in the first scanning scheme. The left-hand side of FIG. 22(B) shows the nozzle numbers #0 through #7. The values on the right-hand side of the nozzle numbers represent which raster lines in the effective record area are recorded by the respective nozzles after the 0th to 7th sub-scan feeds. By way of example, in the main scan after the 0th sub-scan feed (that is, in the first main scan for recording the effective record area), the nozzles #5 through #7 record the 1st, 5th, and 9th effective raster lines. In the main scan after the 1st sub-scan feed, the nozzles #3 through #7 record the 3rd, 7th, 11th, 15th, and 19th effective raster lines. The term "effective raster lines" here denotes the raster lines in the effective record area.

It can be understood that, in FIG. 22(B), a difference between raster numbers of the effective raster lines recorded during one main scan is equal to the nozzle pitch k(=4). One scan cycle accordingly records n×k (that is, 32) raster lines. Since any successive nozzles are apart from each other by the nozzle pitch k, one cycle does not record 32 sequential raster lines as clearly understood from FIG. 21. FIG. 22(B) shows which nozzles are used to record the first 32 raster lines in the effective record area.

In FIG. 22(B), the effective raster numbers written in the brackets show that the raster lines at the positions having the equivalent scanning conditions have been recorded in the previous cycle. Namely the difference obtained by subtracting 32 from the numeral in the brackets indicates the equivalent raster line number. For example, the raster line of the effective raster number 36 recorded by the nozzle #0 is present at the position having the equivalent scanning conditions to those of the raster line of the effective raster number 4.

FIG. 23 shows the nozzle numbers for recording the effective raster lines in the first scanning scheme. The numerals 1 through 31 on the left-end column of FIG. 23 show the effective raster numbers. The right-hand side of FIG. 23 shows the positions of the effective raster lines recorded by the eight nozzles #0 through #7 in the main scans after the respective sub-scan feeds. For example, in the main scan after the 0th sub-scan feed, the nozzles #5 through #7 record the 1st, 5th, and 9th effective raster lines, respectively. Comparison between FIG. 23 and FIG. 22(B) clearly shows the relationship between the effective raster lines and the nozzle numbers.

Four different symbols "·", "x", "↑", and "↓" in the second-left column of FIG. 23 show whether or not the adjoining raster lines have already been recorded before the recording of each raster line. The respective symbols have the following meaning:

↓: Only one raster line immediately below itself has already been recorded.

↑: Only one raster line immediately above itself has already been recorded.

x: Both raster lines above and below itself have already been recorded.

·: Neither of the raster lines above and below itself have been recorded.

The recording state of the adjoining raster lines above and below each raster line affects the image quality of the raster line being recorded. The effects on the image quality are ascribed to the dryness of ink on the adjoining raster lines that have already been recorded and to sub-scan feed errors. If the pattern by the four different symbols appears at a relatively large interval, it may deteriorate the image quality of the whole image. In the first scanning scheme shown in FIG. 23, however, the pattern by the four different symbols does not show any clear periodicity. It is accordingly expected that the first recording scheme causes less deterioration of the image quality due to this reason but enables an image of relatively high image quality to be recorded.

The third-left column of FIG. 23 shows the value Δ representing how many sub-scan feeds have been executed at the maximum between recording of each raster line and recording of the adjoining raster line. The value Δ is hereinafter referred to as the "sub-scan feed number difference". By way of example, the second effective raster line is recorded by the nozzle #1 after the 2nd sub-scan feed, whereas the first raster line is recorded by the nozzle #5 after the 0th sub-scan feed and the third raster line is recorded by the nozzle #3 after the 1st sub-scan feed. The sub-scan feed number difference Δ is accordingly equal to 2 with respect to the second raster line. In a similar manner, the fourth raster line is recorded after three sub-scan feeds have been executed since recording of the fifth raster line. The sub-scan feed number difference Δ is thus equal to 3 with respect to the fourth raster line.

Since one cycle consists of k(=4) sub-scan feeds, the sub-scan feed number difference Δ may be the value in the range of 0 to k. In the first scanning scheme for k=4, it is understood that the maximum sub-scan feed number difference Δ is equal to 3, which is smaller than the possible upper limit value k(=4).

It is ideal that the sub-scan feed is carried out strictly by the amount equal to an integral multiple of the dot pitch. In the actual state, however, the sub-scan feed has some feeding error. The sub-scan feed error is accumulated at every time of sub-scan feed. When a large number of sub-scan feeds are interposed between recording of adjoining two raster lines, the accumulated sub-scan feed error may cause a positional misalignment of the adjoining two raster lines. As mentioned above, the sub-scan feed number difference Δ shown in FIG. 23 denotes the number of sub-scan feeds carried out between recording of the adjoining raster lines. The smaller sub-scan feed number difference Δ is preferable, in order to minimize the positional misalignment of the adjoining raster lines due to the accumulated sub-scan feed error. In the first scanning scheme for k=4 shown in FIG. 23, the sub-scan feed number difference Δ is not greater than 3 and is smaller than the upper limit value 4. This allows a favorable, image to be recorded from this viewpoint.

The first scanning scheme described above may be applied to drive the print head 2 (see FIG. 9) in the first embodiment as well as to drive the print head 11 (see FIG. 14) in the second embodiment. It should, however, be noted that the scanning parameters in the first scanning scheme relate to one nozzle group (either the even nozzle array or the odd nozzle array in the first embodiment). The dot recording processes of the first and second embodiments described above are characterized by the procedure of forming each pixel, and the first and the second embodiments are thus arbitrarily applicable to the cases of different settings for the sub-scan feed amounts L in the scanning scheme and the different recording sequence of the respective pixels on an identical raster line. The first and second embodiments are also applicable to a variety of other scanning schemes described below.

FIG. 24 shows the scan parameters and the raster numbers of the effective raster lines recorded by the respective nozzles in a third scanning scheme using plural values of sub-scan feed amounts. In the second scanning scheme, the nozzle pitch k is equal to 8 dots and the number of used nozzles n is equal to 16. The number of scan repeats is equal to 1. Like the first scanning scheme, the second scanning scheme has the first feature that the nozzle pitch k and the number of used nozzles n are integers which are no less than 2 and which are not relatively prime, and the second feature that a plurality of different values are used for the sub-scan feed amount L.

FIG. 25 shows the nozzle numbers for recording the effective raster lines in the second scanning scheme. In the second scanning scheme, the pattern of the symbols @ representing the recording state of the adjoining raster lines above and below each raster line does not have a significantly large period. It is accordingly expected to attain the relatively high image quality. The difference in number of sub-scan feeds Δ is equal to either 3 or 5, which is significantly smaller than the possible upper limit 8. This arrangement reduces the accumulated error of sub-scan feed and thereby enables a favorable image to be recorded.

In addition to the two features discussed above, the second scanning scheme has another feature with respect to the sub-scan feed amount L. In the second scanning scheme, the sub-scan feed amount L assumes values of 13 and 21 and the offset G (=L%k) of the sub-scan feed amount L is a constant value as shown in the table of FIG. 24(A). The offset G denotes a deviation of the periodical positions (that is, the phase deviation) of the plurality of nozzles after a sub-scan feed from the periodical positions of these nozzles before the sub-scan feed. For example, when the offset G is equal to zero (that is, when the sub-scan feed amount L is an integral multiple of the nozzle pitch k), the periodical positions of the nozzles after the sub-scan feed overlaps the periodical position of the nozzles before the sub-scan feed. In order to avoid such an overlap, the offset G is generally not equal to zero. According to the periodicity of the arrangement of the nozzles, the fixed offset G with respect to the sub-scan feed amount L causes the nozzles to be fed by a fixed amount of shift in the sub-scanning direction. By way of example, when the offset G is equal to 1, the nozzles will be arranged at the positions whose phase is shifted downward by one raster line from the nozzle positions before the sub-scan feed.

The offset G of the sub-scan feed amount L will not be equal to zero in any case. As clearly understood from the definition of the offset G, the value of the offset G is smaller than the nozzle pitch k. Especially when the offset G is constant, the offset G is set at an integer that is relatively prime to the nozzle pitch k. Such setting enables the condition c2' discussed above, that is, 'The offset F of the nozzles after each sub-scan feed included in one cycle takes a value in the range of 0 to k−1) and the value is repeated s times.', to be satisfied. A desirable value for the constant offset G of the sub-scan feed amount L is determined by considering the following factors.

FIG. 26 shows an example of the scanning scheme when the offset G is fixed to one. In this example, the raster line 9 is recorded after a first sub-scan feed in the effective recording area. The raster line 8 is recorded after seven sub-scan feeds since then. The errors of k times of sub-scan feeds re accordingly accumulated between these two raster lines. The raster lines 18 and 17 hold a similar relation. With a view to preventing the error of sub-scan feed from being accumulated, it is desirable to set the sub-scan feed amount L in such a manner that the offset G of the sub-scan feed amount L has a value other than 1. Like the case of G=1, in the case of the offset G equal to (k−1), the error of k sub-scan feeds is accumulated. It is accordingly desirable to set the offset G equal to a value other than (k−1).

In the example of FIG. 26, the pattern of the symbols @ representing the recording state of the adjoining raster lines above and below each raster line shows a significantly large cycle. It is accordingly possible that a pattern of the large cycle is observed in a recorded image. In order to prevent the periodic pattern from appearing, it is preferable that the constant offset G is set at a value other than 1 and (k−1) to.

When taking into account of the above factors, the constant offset G is preferably set at a value which is prime to the nozzle pitch k and in the range of 2 to (k−2) when the offset G of the sub-scan feed amount L is fixed to a constant value. FIG. 27 shows preferable combinations of the nozzle pitch k and the offset G of the sub-scan feed amount. The values shown in FIG. 27 all satisfy the conditions of the desirable offset G.

When the offset G is equal to either 1 or (k−1), adjoining raster lines are recorded in a successive manner. In this case, before the ink is dried on a raster line just recorded, the recording on an adjoining raster line starts, thereby causing a blur of ink. The similar phenomenon occurs not only when the offset G has a constant value but the offset G is varied for each sub-scan feed amount L. In order to prevent the blur of ink, whether or not the offset G of the sub-scan feed amount L is constant, it is preferable to set the sub-scan feed amount L so that the offset G takes a value other than 1 and (k−1).

In the second scanning scheme, the plurality of values (13 and 21) are used for the sub-scan feed amount L, and the offset G of the sub-scan feed amount L is a preferable constant value. This arrangement effectively prevents the accumulation of the sub-scan feed errors, thereby enabling an image of high image quality to be recorded.

FIGS. 28(A) and 28(B) show the scan parameters and the raster numbers of the effective raster lines recorded by the respective nozzles in a third scanning scheme using plural values of sub-scan feed amounts. The difference between the third scanning scheme and the second scanning scheme shown in FIGS. 24(A) and 24(1) is only the sub-scan feed amount L. Like the second scanning scheme, the third scanning scheme has the first feature that the nozzle pitch k and the number of used nozzles n are integers which are no less than 2 and which are not relatively prime, and the second feature that a plurality of different values are used for the sub-scan feed amount L. The third scanning scheme also has the third feature that the offset G (=L%k) of the sub-scan feed amount L is a constant value. As shown in FIG. 27 discussed above, the value (=5) of the offset G of the sub-scan feed amount L in the third scanning scheme is an especially preferable one.

FIG. 29 shows the nozzle numbers for recording the effective raster lines in the third scanning scheme. Like the second scanning scheme shown in FIG. 25, in the third scanning scheme, the pattern of the symbols @ representing the recording state of the adjoining raster lines above and below each raster line does not have a significantly large cycle. It is accordingly expected to attain a relatively favorable image quality. Since the difference in number of sub-scan feeds Δ is equal to either 3 or 5, which is significantly smaller than the possible upper limit 8, a favorable image can be recorded from the viewpoint of smaller accumulated error of the sub-scan feed.

Having the variety of features that are substantially similar to those of the second scanning scheme, the third scanning scheme can record a high quality image in the same manner as the second scanning scheme.

FIG. 30 shows the scan parameters in a fourth scanning scheme using plural values of sub-scan feed amounts. In the fourth scanning scheme, the nozzle pitch k is equal to 8 dots and the number of used nozzles n is equal to 32. The number of scan repeats s is equal to 2 and the number of effective nozzles neff is equal to 16. As clearly understood from the comparison with the parameters in the third scanning scheme shown in FIG. 28, the number of effective nozzles neff in the fourth scanning scheme is kept equal to that in the third scanning scheme, whereas the number of scan repeats s is set equal to 2 and the number of used nozzles n is doubled in the fourth scanning scheme. Since the nozzle pitch k and the number of effective nozzles neff in the fourth scanning scheme are equal to those in the third scanning scheme, the same values as those of the third scanning scheme are used for the sub-scan feed amount L. However, since the eight sub-scan feeds shown in the table of FIG. 30 records the raster lines only once, another eight sub-scan feeds are executed to record dots without any space. The eight sub-scan feeds shown in the table of FIG. 30 accordingly correspond to the sub-cycle in FIG. 20(A) discussed previously.

FIG. 31 shows the raster numbers of the effective raster lines recorded by the respective nozzles in the fourth scanning scheme. The raster numbers of FIG. 31 are similar to those of the third scanning scheme shown in FIGS. 28(A) and 28(B). The raster line with a negative number represents that dots are recorded at the positions which are shifted by one dot in the main scanning direction on the raster line. FIG. 32 shows the nozzle numbers for recording the effective raster lines in the fourth scanning scheme. In FIG. 32, the nozzle with a negative number represents that the nozzle records dots at the positions which are shifted by one dot in the main scanning direction. As clearly understood from the drawing, two nozzles of different numbers are positioned on the same raster line, and the respective nozzles record dots at the positions which are shifted by one dot in the main scanning direction on the raster line. This enables all the dots in the effective recording area to be recorded. In general, s pieces of different nozzles (s denotes the number of scan repeats) are positioned on the same raster line, and the s pieces of nozzles respectively record dots at the positions which are shifted from one another in the main scanning direction on the raster line.

Having similar features to those of the third scanning scheme except for the number of scan repeats s, the fourth scanning scheme can record a high quality image in the same manner as the third scanning scheme.

Although the above embodiments are concerned with scanning schemes for one color, application of the scanning scheme to each color will implement color printing with plural colors of inks.

The principle of the present invention is applicable not only to the color printing but to the monochrome printing. The present invention is also applicable to the printing that expresses each pixel with a plurality of dots to attain multi-tones. The present invention is further applicable to drum scan printers. In the drum scan printer, the rotating direction of the drum corresponds to the main scanning direction, and the feeding direction of the carriage corresponds to the sub-scanning direction. The present invention is applicable not only to the ink jet printers but in general to any dot recording apparatuses that record dots on the surface of a printing medium with a recording head having plural arrays of dot-forming elements. The "dot-forming elements" here denote elements for forming the dots, such as the ink nozzles in the ink jet printer.

The structure embodied by hardware circuitry in the above embodiments can be replaced by software, and on the contrary, the structure embodied by software can be replaced by hardware circuitry. For example, the function of the control circuit 40 of the color printer 22 (FIG. 2) may be implemented by the computer. In this case, a computer program such as the printer driver 96 executed the same control function as that of the control circuit 40.

The computer programs for implementing those functions are provided as stored on a computer readable medium, such as floppy disks or CD-ROMs. The computer 90 reads the computer programs from the storage medium and transfer them to the internal storage device or to the external storage device. Alternatively the computer programs may be supplied from a program supply apparatus to the computer 90 via a communications path. At the time of executing the functions of the computer programs, the programs stored in the main memory are executed by the microprocessor of the computer 90. Alternatively, the computer 90 may read out computer programs stored on the storage medium to directly execute it.

In the specification hereof, the term computer 90 implies both the hardware and its operating system and more specifically represents the hardware operating under the control of the operating system. The computer programs cause the computer 90 to implement the above functions. Part of these functions may be implemented by the operating system instead of the applications programs.

The "computer readable medium" in the present invention is not restricted to the portable storage medium, but includes a variety of internal storage devices in the computer, for example, RAMs and ROMs, and external storage devices connected with the computer, for example, hard disks.

As described above, under the condition of the 3-value outputs, the present invention newly spouts an ink droplet upon the dot formed in advance, thereby forming a nearly complete round dot of a greater diameter. This arrangement alleviates the occurrence of banding and ensures the high-quality multi-value outputs without requiring complicated control.

Moreover, the superposing of the dots having different densities ensures the more minute multi-value outputs.

The arrangement of the ink jet printer according to the present invention is applicable to any printer that jets ink droplets with a variety of actuators, such as piezoelectric elements and heaters.

What is claimed is:

1. An ink jet recording apparatus comprising:

a print head having a plurality of nozzles;

a main scan driving unit that drives the print head in a predetermined main scanning direction relative to a printing medium;

a sub-scan driving unit that drives and feeds the printing medium in a sub-scanning direction, which is perpendicular to the main scanning direction;

a driving unit controller that controls the main scan driving unit and the sub-scan driving unit to position the print head at predetermined locations;

a data storage unit that stores print image data including multi-value tone information; and a print head-driving unit that supplies electric power to the print head to jet ink onto the printing medium based on the print image data stored in the data storage unit;

the print head including a plurality of nozzle groups, each nozzle group forming dots of substantially identical color, the print head being driven to enable each nozzle group to record all pixels in an effective recording area on the printing medium;

wherein the print head-driving unit has a multi-value output mode in which the print head is driven so that the print head can put a plurality of dots having the substantially identical color one upon another at an identical position using the plurality of nozzle groups, to thereby form multi-value dots representing multi-levels;

wherein each of the plurality of nozzle groups includes N nozzles (N being a positive integer) arranged at a nozzle interval k (k being an integer of no less than 2) in the sub-scanning direction; and wherein when the number of used nozzles in the sub-scanning direction in each nozzle group used for printing is equal to n (n being a positive integer of not greater than N), k and n are prime to each other.

2. An ink jet recording apparatus comprising:

a print head having a plurality of nozzles;

a main scan driving unit that drives the print head in a predetermined main scanning direction relative to a printing medium;

a sub-scan driving unit that drives and feeds the printing medium in a sub-scanning direction, which is perpendicular to the main scanning direction;

a driving unit controller that controls the main scan driving unit and the sub-scan driving unit to position the print head at predetermined locations;

a data storage unit that stores print image data including multi-value tone information; and a print head-driving unit that supplies electric power to the print head to jet ink onto the printing medium based on the print image data stored in the data storage unit;

the print head including a plurality of nozzle groups, each nozzle group forming dots of substantially identical color, the print head being driven to enable each nozzle group to record all pixels in an effective recording area on the printing medium;

wherein the print head-driving unit has a multi-value output mode in which the print head is driven so that the print head can put a plurality of dots having the substantially identical color one upon another at an identical position using the plurality of nozzle groups, to thereby form multi-value dots representing multi-levels;

wherein the plurality of nozzle groups include an even nozzle array and an odd nozzle array, each having N nozzles (N being a positive integer) arranged at a nozzle interval 2k (being an integer of no less than 2) in the sub-scanning direction, and the even and odd nozzle arrays are apart from each other by a predetermined distance in the main scanning direction; and wherein when the number of used nozzles in the sub-scanning direction in each of the even and odd nozzle arrays used for printing is equal to n (n being a positive integer of not greater than N), 2k and n are prime to each other.

3. An ink jet recording apparatus in accordance with claim 1, wherein the print head driving unit puts the plurality of dots having the substantially identical color one upon another so that the multi-value dots is substantially circular.

4. An ink jet recording apparatus in accordance with claim 1, wherein the plurality of dots having the substantially identical color include a first density dot having a relatively low density and a second density dot having a relatively high density;

wherein the multi-levels include a first tone level attained by the first density dot, a second tone level attained by the second density level, and a third tone level attained by superposing the first and second density dots; and wherein the plurality of nozzle groups include at least one nozzle group for each of the first and second density dots, respectively.

5. An ink jet recording apparatus in accordance with claim 1, wherein the plurality of nozzle groups include at least two nozzle groups for at least one of the first density dot and the second density dot, the at least two nozzle groups being able to record all the pixels in the effective recording area; and wherein the multi-levels further include a tone level at which the at least nozzle groups are used to superpose a plurality of identical density dots one upon another.

6. An ink jet recording apparatus in accordance with claim 1, wherein the plurality of nozzle groups include at least two nozzle groups for each of the first density dot and the second density dot, the at least two nozzle groups being able to record all the pixels in the effective recording area; and wherein the multi-levels further include a fourth tone level at which a plurality of the first density dots are laid one upon another and a fifth tone level at which a plurality of the second density dots are laid one upon another.

7. An ink jet recording apparatus in accordance with claim 1, wherein the data storage unit includes a plurality of data blocks for an identical ink, each of the plurality of data blocks storing one bit of pixel information of print image data; and wherein the plurality of data blocks are related to the plurality of nozzle groups so that 1-bit print image data in each data block is used as data for the related nozzle group.

8. An ink jet recording apparatus in accordance with claim 1, wherein the driving unit controller has a medium-feed operation mode in which a feed amount of the sub-scan driving unit is fixed to n dots.

9. An ink jet recording apparatus in accordance with claim 1, wherein the driving unit controller uses a combination of a plurality of different values for feed amounts of a plurality of sub-scans.

10. An ink jet recording apparatus in accordance with claim 1, wherein the print head carries out a plurality of ink-droplet jetting operations for the plurality of dots of the substantially identical color, the plurality of operations being carried out in different main scans, respectively.

11. A computer readable recording medium storing a computer program used in a computer that comprises a printing unit having a plurality of nozzle groups for forming dots of a substantially identical color and a data storage unit for storing print image data including multi-value tone information, the computer program being used for forming dots on a printing medium with the print head;

wherein the recording medium storing the computer program for causing the computer to implement a print head driving function for controlling spout of ink droplets on the printing medium based on print image data;

wherein the print head driving function has a multi-value output mode in which a plurality of dots having the substantially identical color are laid one upon another at an identical position by the plurality of nozzle groups, to thereby form multi-value dots representing multi-levels;

wherein each of the plurality of nozzle groups includes N nozzles (N being a positive integer) arranged at a nozzle interval k (k being an integer of no less than 2) in the sub-scanning direction; and wherein when the number of used nozzles in the sub-scanning direction in each nozzle group used for printing is equal to n (n being a positive integer of not greater than N), k and n are prime to each other.

12. A computer readable recording medium storing a computer program used in a computer that comprises a printing unit having a plurality of nozzle groups for forming dots of a substantially identical color and a data storage unit for storing print image data including multi-value tone information, the computer program being used for forming dots on a printing medium with the print head;

wherein the recording medium storing the computer program for causing the computer to implement a print head driving function for controlling spout of ink droplets on the printing medium based on print image data;

wherein the print head driving function has a multi-value output mode in which a plurality of dots having the substantially identical color are laid one upon another at an identical position by the plurality of nozzle groups, to thereby form multi-value dots representing multi-levels;

wherein the plurality of nozzle groups include an even nozzle array and an odd nozzle array, each having N nozzles (N being a positive integer) arranged at a nozzle interval 2k (k being an integer of no less than 2) in the sub-scanning direction, and the even and odd nozzle arrays are apart from each other by a predetermined distance in the main scanning direction; and wherein when the number of used nozzles in the sub-scanning direction in each of the even and odd nozzle arrays used for printing is equal to n (n being a positive integer of not greater than N), 2k and n are prime to each other.

13. An ink jet recording apparatus in accordance with claim 12, wherein the print head driving unit puts the plurality of dots having the substantially identical color one upon another so that the multi-value dots is substantially circular.

14. An inkjet recording apparatus in accordance with claim 12, wherein the plurality of dots having the substantially identical color include a first density dot having a relatively low density and a second density dot having a relatively high density;

wherein the multi-levels include a first tone level attained by the first density dot, a second tone level attained by the second density level, and a third tone level attained by superposing the first and second density dots; and wherein the plurality of nozzle groups include at least one nozzle group for each of the first and second density dots, respectively.

15. An ink jet recording apparatus in accordance with claim 12, wherein the plurality of nozzle groups include at least two nozzle groups for at least one of the first density dot and the second density dot, the at least two nozzle groups being able to record all the pixels in the effective recording area; and wherein the multi-levels further include a tone level at which the at least nozzle groups are used to superpose a plurality of identical density dots one upon another.

16. An ink jet recording apparatus in accordance with claim 12, wherein the plurality of nozzle groups include at least two nozzle groups for each of the first density dot and the second density dot, the at least two nozzle groups being able to record all the pixels in the effective recording area; and wherein the multi-levels further include a fourth tone level at which a plurality of the first density dots are laid one upon another and a fifth tone level at which a plurality of the second density dots are laid one upon another.

17. An ink jet recording apparatus in accordance with claim 12, wherein the data storage unit includes a plurality of data blocks for an identical ink, each of the plurality of data blocks storing one bit of pixel information of print image data; and wherein the plurality of data blocks are related to the plurality of nozzle groups so that 1-bit print image data in each data block is used as data for the related nozzle group.

18. An ink jet recording apparatus in accordance with claim 12, wherein the driving unit controller has a medium-feed operation mode in which a feed amount of the sub-scan driving unit is fixed to n dots.

19. An ink jet recording apparatus in accordance with claim 12, wherein the driving unit controller uses a combination of a plurality of different values for feed amounts of a plurality of sub-scans.

20. An ink jet recording apparatus in accordance with claim 12, wherein the print head carries out a plurality of ink-droplet jetting operations for the plurality of dots of the substantially identical color, the plurality of operations being carried out in different main scans, respectively.

* * * * *